US007850823B2

(12) United States Patent
Chou et al.

(10) Patent No.: US 7,850,823 B2
(45) Date of Patent: Dec. 14, 2010

(54) METHOD OF CONTROLLING ADHESIVE BUILD-UP ON A YANKEE DRYER

(75) Inventors: Hung Liang Chou, Neenah, WI (US); Kang Chang Yeh, Neenah, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 744 days.

(21) Appl. No.: 11/678,669

(22) Filed: Feb. 26, 2007

(65) Prior Publication Data

US 2007/0204966 A1 Sep. 6, 2007

Related U.S. Application Data

(60) Provisional application No. 60/779,614, filed on Mar. 6, 2006.

(51) Int. Cl.
*D21F 13/00* (2006.01)

(52) U.S. Cl. ..... 162/199; 162/112; 162/117; 162/158

(58) Field of Classification Search ..... 162/199, 162/112, 117, 118, 158, 109, 111
See application file for complete search history.

(56) References Cited

U.S. PATENT DOCUMENTS

| | | | | |
|---|---|---|---|---|
| 2,926,116 | A | 2/1960 | Keim | 162/164 |
| 3,058,873 | A | 10/1962 | Keim et al. | 162/164 |
| 3,556,932 | A | 1/1971 | Coscia et al. | 162/166 |
| 3,556,933 | A | 1/1971 | Williams et al. | 162/167 |
| 3,772,076 | A | 11/1973 | Keim | 162/164.3 |
| 3,974,025 | A | 8/1976 | Ayers | 162/113 |
| 3,994,771 | A | 11/1976 | Morgan, Jr. et al. | 162/113 |
| 4,064,213 | A * | 12/1977 | Lazorisak et al. | 264/134 |
| 4,102,737 | A | 7/1978 | Morton | 162/113 |
| 4,239,065 | A | 12/1980 | Trokhan | 130/393 AA |
| 4,490,925 | A | 1/1985 | Smith | 34/42 |
| 4,528,316 | A | 7/1985 | Soerens | 162/109 |
| 4,529,480 | A | 7/1985 | Trokhan | 162/109 |
| 4,533,437 | A | 8/1985 | Curran et al. | 162/281 |
| 4,543,156 | A | 9/1985 | Cheshire et al. | 162/101 |
| 4,551,199 | A | 11/1985 | Weldon | 162/109 |
| 4,605,702 | A | 8/1986 | Guerro et al. | 525/154 |
| 4,689,119 | A | 8/1987 | Weldon | 162/281 |
| 4,720,383 | A | 1/1988 | Drach et al. | 424/70.21 |
| 4,795,530 | A | 1/1989 | Soerens et al. | 162/111 |
| 4,834,838 | A | 5/1989 | Klowak | 162/109 |
| 4,849,054 | A | 7/1989 | Klowak | 162/109 |
| 5,048,589 | A * | 9/1991 | Cook et al. | 162/109 |
| 5,338,807 | A | 8/1994 | Espy et al. | 525/439 |
| 5,449,026 | A | 9/1995 | Lee | 139/383 A |
| 5,607,551 | A | 3/1997 | Farrington, Jr. et al. | 162/109 |
| 5,690,149 | A | 11/1997 | Lee | 139/383 A |
| 5,961,782 | A | 10/1999 | Luu et al. | 162/111 |
| 6,133,405 | A | 10/2000 | Allen | 528/310 |
| 6,187,137 | B1 | 2/2001 | Druecke et al. | 162/109 |
| 6,207,011 | B1 | 3/2001 | Luu et al. | 162/111 |
| 6,350,349 | B1 | 2/2002 | Hermans et al. | 162/111 |
| 6,432,267 | B1 | 8/2002 | Watson | 162/111 |
| 6,447,640 | B1 | 9/2002 | Watson et al. | 162/101 |
| 6,669,821 | B2 | 12/2003 | Edwards et al. | 162/358.1 |
| 6,964,117 | B2 | 11/2005 | Parent | 34/528 |
| 2003/0040574 | A1 | 2/2003 | Schertz et al. | 525/57 |
| 2003/0059563 | A1 | 3/2003 | Bourdelais et al. | 428/40.1 |
| 2004/0050514 | A1 | 3/2004 | Shannon et al. | 162/158 |
| 2004/0211534 | A1 * | 10/2004 | Clungeon et al. | 162/111 |
| 2004/0238135 | A1 | 12/2004 | Edewards et al. | 162/111 |
| 2005/0006040 | A1 * | 1/2005 | Boettcher et al. | 162/111 |
| 2005/0217814 | A1 | 10/2005 | Super et al. | 162/111 |
| 2005/0241786 | A1 | 11/2005 | Edwards et al. | 162/109 |
| 2005/0241787 | A1 | 11/2005 | Murray et al. | 162/113 |
| 2005/0279471 | A1 | 12/2005 | Murray et al. | 162/111 |
| 2006/0000567 | A1 | 1/2006 | Murray et al. | 162/111 |
| 2006/0237154 | A1 | 10/2006 | Edwards et al. | 162/111 |
| 2006/0289133 | A1 | 12/2006 | Yeh et al. | 162/109 |
| 2006/0289134 | A1 | 12/2006 | Yeh et al. | 162/111 |
| 2008/0264589 | A1 * | 10/2008 | Chou et al. | 162/112 |

FOREIGN PATENT DOCUMENTS

| | | |
|---|---|---|
| CA | 2053505 | 4/1992 |
| WO | WO 01/85109 A1 | 11/2001 |

OTHER PUBLICATIONS

U.S. Appl. No. 11/804,246, filed May 16, 2007, Edwards et al.
U.S. Appl. No. 11/867,113, filed Oct. 4, 2007, Kokko et al.
U.S. Appl. No. 60/903,789, filed Feb. 27, 2007, Chou et al.
U.S. Appl. No. 60/881,310, filed Jan. 19, 2007, Sumnicht.
Wet-Strength Resins and Their Applications, Ch. 2, H. Espy, entitled Alkaline-Curing Polymeric Amine-Epichlorohydrin Resins.
Cellulose Chemistry and Technology, Westfelt, vol. 813, p. 18, 1979.
Chemistry and Industry, Evans, Jul. 5, 1969, pp. 893-903.
J. Am. Oil Chemist's Soc., Egan, vol. 55 (2978), pp. 118-121.
J. Am. Chemist's Soc., Trivedi et al., Jun. 1981, op. 754-756.

* cited by examiner

*Primary Examiner*—Mark Halpern
(74) *Attorney, Agent, or Firm*—Laura L. Bozek

(57) ABSTRACT

An improved method of controlling build-up of adhesive coating on a Yankee drying cylinder preferably includes intermittently: (a) increasing the add-on rate of resinous adhesive to the drying cylinder substantially above the steady-state add-on rate; (b) segregating the absorbent sheet product produced while the add-on rate of resinous adhesive to the drying cylinder is elevated above the steady-state add-on rate from absorbent sheet product accumulated during steady-state operation; and (c) while the add-on rate of resinous adhesive to the drying cylinder is increased above the steady-state add-on rate, stripping at least a portion of the adhesive coating from the drying cylinder with a cleaning doctor.

51 Claims, 3 Drawing Sheets

METHOD OF CONTROLLING ADHESIVE BUILD-UP ON A YANKEE DRYER

CLAIM FOR PRIORITY

This application is based upon U.S. Provisional Patent Application No. 60/779,614 of the same title filed Mar. 6, 2006. The priority of U.S. Patent Application No. 60/779,614 is hereby claimed and its disclosure incorporated herein by reference.

TECHNICAL FIELD

The present invention relates to the manufacture of absorbent cellulosic sheet of the class used for tissue and towel. There is provided in accordance with the invention a method of controlling adhesive build-up on a Yankee dryer.

BACKGROUND ART

Methods of making paper tissue, towel, and the like are well known, including various features such as Yankee drying, throughdrying, fabric creping, dry creping, wet creping and so forth. Conventional wet pressing/dry creping processes (CWP) have certain advantages over conventional through-air drying processes including: (1) lower energy costs associated with the mechanical removal of water rather than transpiration drying with hot air; and (2) higher production speeds which are more readily achieved with processes which utilize wet pressing to form a web. On the other hand, through-air drying processing has been widely adopted for new capital investment, particularly for the production of soft, bulky, premium quality tissue and towel products.

Throughdried, creped products and processes (TAD) products and processes) are disclosed in the following patents: U.S. Pat. No. 3,994,771 to Morgan, Jr. et al.; U.S. Pat. No. 4,102,737 to Morton; and U.S. Pat. No. 4,529,480 to Trokhan. The processes described in these patents comprise, very generally, forming a web on a foraminous support, thermally pre-drying the web, applying the web to a Yankee dryer with a nip defined, in part, by an impression fabric, and creping the product from the Yankee dryer. A relatively permeable web is typically required, making it difficult to employ recycle furnish at levels which may be desired. Transfer to the Yankee typically takes place at web consistencies of from about 60% to about 70%. See also, U.S. Pat. No. 6,187,137 to Druecke et al. which includes disclosure of peeling a web from a Yankee dryer. As noted in the above, throughdried products tend to exhibit enhanced bulk and softness; however, thermal dewatering with hot air tends to be energy intensive. Wet-press/dry crepe operations wherein the webs are mechanically dewatered are preferable from an energy perspective and are more readily applied to furnishes containing recycle fiber which tends to form webs with less uniform permeability than virgin fiber. Moreover, line speeds tend to be higher with wet-press operations.

A wet web may also be dried or initially dewatered by thermal means by way of impingement air drying. Suitable rotary impingement air drying equipment is described in U.S. Pat. No. 6,432,267 to Watson and U.S. Pat. No. 6,447,640 to Watson et al.

Fabric creping has been employed in connection with papermaking processes which include mechanical or compactive dewatering of the paper web as a means to influence product properties. See U.S. Pat. Nos. 4,689,119 and 4,551,199 of Weldon; 4,849,054 and 4,834,838 of Klowak; and 6,287,426 of Edwards et al. Operation of fabric creping processes has been hampered by the difficulty of effectively transferring a web of high or intermediate consistency to a dryer. Note also U.S. Pat. No. 6,350,349 to Hermans et al. which discloses wet transfer of a web from a rotating transfer surface to a fabric. Further United States patents relating to fabric creping more generally include the following: U.S. Pat. Nos. 4,834,838; 4,482,429; 4,445,638 as well as U.S. Pat. No. 4,440,597 to Wells et al. Newer and preferred aspects of processes including fabric-creping are described in the following applications: U.S. application Ser. No. 10/679,862 (Publication No. US-2004-0238135), entitled "Fabric Crepe Process for Making Absorbent Sheet" which application, incorporated herein by reference, discloses particular papermachine details as well as creping techniques, equipment and properties; U.S. application Ser. No. 11/108,375 (Publication No. US 2005-0217814), entitled "Fabric Crepe/Draw Process for Producing Absorbent Sheet" also incorporated herein by reference, provides still further processing and composition information; U.S. application Ser. No. 11/108,458 (Publication No. US 2005-0241787), entitled "Fabric Crepe and In Fabric Drying Process for Producing Absorbent Sheet" and U.S. application Ser. No. 11/104,014 (Publication No. US 2005-0241786), entitled "Wet-Pressed Tissue and Towel Products With Elevated CD Stretch and Low Tensile Ratios Made With a High Solids Fabric Crepe Process" both of which are incorporated herein by reference, provide some further variation as to selection of components and processing techniques. Another application, U.S. Ser. No. 11/451,111, filed Jun. 12, 2006, entitled "Fabric Creped Sheet for Dispensers" incorporated herein by reference, provides information on suitable drying and other manufacturing techniques.

Papermaking processes utilizing creping adhesive, utilizing one or more of the technologies referred to above, are thus well known in the art. It is well-known, for example, that a portion of the bulk of a tissue paper web made by way of conventional wet pressing is usually imparted by creping wherein creping adhesive plays an important role. The level of adhesion of the papermaking web to a dryer cylinder is also of importance as it relates to transfer of the web to a drying cylinder as well as control of the web in between the dryer and the reel upon which a roll of the paper is being formed. Webs which are insufficiently adhered may blister or, even worse, become disengaged from a drying cylinder and cause a hood fire. Moreover, insufficient wet-tack may lead to a transfer failure wherein the web fails to transfer to a drying cylinder and remains imbedded in a fabric causing shutdowns and waste of material and energy. Further, the level of adhesion of the papermaking web to the dryer is of importance as it relates to the drying of the web. Higher levels of adhesion reduce the impedance to heat transfer and cause the web to dry faster, enabling more energy efficient, higher speed operation; provided excessive build-up of adhesive is avoided. Note, however that some build-up is desirable inasmuch as adhesion of the sheet to the dryer occurs largely by means of creping adhesive deposited in previous passes.

Thickness of a coating layer on a Yankee drying cylinder typically increases with time, insulating a wet web from the Yankee surface. In other words, the adhesive coating build-up on the Yankee reduces heat transfer from the Yankee surface. To maintain the same moisture level in the finished product, the Yankee hood temperature is increased accordingly. After two to three hours the hood temperature reaches its upper ceiling and the coating layer needs to be stripped off to reduce the hood temperature to a normal operating window. A new cleaning doctor is typically used to strip off the old coating build-up.

Stripping of the coating, however, results in sheet transfer problems at the pressure roll due to blistering and edge floating.

The problems are more severe when the basis weight of the sheet is reduced. To achieve texturing with lower basis weight, a molding box may be set to a maximum level that results in lower contact areas between the sheet and the Yankee surface when the web is applied to the Yankee surface. Consequently, the sheet develops less adhesion with the Yankee at a constant level of coating application. In addition to this issue, the heat transfer of the Yankee improves significantly immediately after the new cleaning doctor strips off excess coating. This results in a very hot surface and sheet blistering is more severe as the moisture is evaporated. An approach to achieve base sheet caliper with lower basis weight is to reduce wet pressing pressure, which results in a wetter web entering the pressure roll nip and reduces durability of the coating. Consequently less Yankee adhesion and more sheet blistering issues occur.

The present invention provides an improved method to control adhesive build-up which includes intermittently increasing the amount of adhesive supplied to a drying cylinder concurrently with stripping excess adhesive build-up.

SUMMARY OF INVENTION

The inventive method of controlling adhesive build-up is advantageously practiced in connection with a wet press/fabric crepe process where the web is peeled from a Yankee cylinder described in connection with the Figures in the discussion which follows. Intermittently, the reel is slowed down and the sheet dropped to engage a creping blade such that the product is creped from a Yankee and fed to a broke chute for recycle while the hood temperature is also reduced. The add-on of adhesive is increased and excess coating is stripped from the Yankee while the product is being creped from the cylinder. Steady-state conditions and peeling from the Yankee are resumed after stripping, suitably within minutes.

The present invention is thus directed, in part, to controlling build-up of an adhesive coating on a drying cylinder by way of intermittently: (a) increasing the add-on rate of resinous adhesive to the drying cylinder above the steady-state add-on rate; (b) segregating the absorbent sheet product produced while the add-on rate of resinous adhesive to the drying cylinder is elevated above the steady-state add-on rate from the absorbent sheet product accumulated on the reel during steady-state operation; and (c) while the add-on rate of resinous adhesive to the drying cylinder is increased above the steady-state add on rate, stripping at least a portion of the adhesive coating from the drying cylinder with a cleaning doctor. In one embodiment, the resinous adhesive comprises a PVOH resin and a polyamide-epihalohydrin resin in substantially fixed proportion during steady-state operation and the increase of resinous adhesive add-on rate to the drying cylinder above the steady-state add-on rate is achieved by increasing the add-on rate of PVOH resin above a steady-state add-on rate of PVOH resin while maintaining the add-on rate of polyamide-epihalohydrin resin substantially at its rate of addition during steady-state operation. Generally, a major portion of the coating is stripped from the drying cylinder, typically at least about 85% of the coating thickness is stripped from the drying cylinder. In most cases the steady-state add-on rate of adhesive is increased at least about 25% above the steady-state add-on rate before cleaning the cylinder.

The resinous adhesive may be rewettable and include polyvinyl alcohol and a polyamide-epichlorohydrin resin. The weight ratio of polyvinyl alcohol resin to polyamide-epichlorohydrin resin is typically from about 2 to about 4. The add-on rate of polyvinyl alcohol in such systems is increased by at least about 50% with respect to a steady-state add-on rate of polyvinyl alcohol when the drying cylinder is being cleaned. Typically the add-on rate of polyvinyl alcohol is increased by at least about 100% during stripping excess coating from the drying cylinder.

In one aspect of the invention, the dryer is provided with a dryer hood capable of variable temperature; and the temperature of the drying hood is lowered during the step of stripping resinous adhesive from the drying cylinder. Generally, the hood temperature at a dry-end is lowered by at least about 25° F. concurrently with the step of stripping resinous adhesive from the drying cylinder, and the hood temperature at a wet end is lowered by at least about 25° F. More typically, the hood temperature at a dry-end is lowered by at least about 50° F. during the step of stripping resinous adhesive from the drying cylinder, and the hood temperature at a wet end is lowered by at least about 50° F. In some cases the hood temperature at a dry-end is lowered by at least about 100° F. during the step of stripping resinous adhesive from the drying cylinder, and the hood temperature at a wet end is lowered by at least about 100° F. The dry end temperature in commercial embodiments will cascade from the wet end temperature under feedback control in order to control moisture in the product prior to winding on the reel.

Generally it is advantageous to practice a resinous adhesive add-on rate of from about 15 mg/m$^2$ to about 60 mg/m$^2$ during steady-state operation of known paper making processes with the improved method of the invention. When practicing a process wherein the sheet is peeled from the dryer, add-on rates of less than about 40 mg/m$^2$, or less than about 35 mg/m$^2$ or even less than about 30 mg/m$^2$ are typical for steady-state operation.

The process of the invention is advantageously practiced when the absorbent sheet has a basis weight of from about 10 lbs/3000 ft$^2$ to about 25 lbs/3000 ft$^2$. The process is particularly advantageous when the absorbent sheet has a basis weight of from about 15 lbs/3000 ft$^2$ to about 21 lbs/3000 ft$^2$. In commercially practiced embodiments, the resin adhesive composition will typically include a creping modifier. Creping modifiers may include a quaternary ammonium complex with a noncyclic amide functionality as is described in co-pending U.S. patent application Ser. No. 10/409,042 (Publication No. US 2005-0006040), filed Apr. 9, 2003, entitled "Creping Adhesive Modifier and Process for Producing Paper Products", the disclosure of which is incorporated herein by reference.

In a typical process, at least a portion of the segregated absorbent sheet product is recycled to the process, for example, fed to a broke chute for re-pulping.

In another aspect of the invention, the improvement includes controlling build-up of an adhesive coating on the drying cylinder by way of intermittently: (a) increasing the add-on rate of polyvinyl alcohol adhesive resin to the drying cylinder above the steady-state add-on rate; and (b) while the add-on rate of polyvinyl alcohol adhesive resin to the drying cylinder is increased above the steady-state add-on rate, stripping at least a portion of the adhesive coating from the drying cylinder with a cleaning doctor.

In yet another aspect of the invention, a continuous process of manufacturing absorbent sheet of the class including forming a wet cellulosic web, applying the web onto a drying cylinder of a dryer, which drying cylinder is provided with a resinous adhesive at a substantially constant add-on rate during steady-state operation, wherein the resin adhesive consists substantially of a PVOH resin and an epihalohydrin resin in substantially fixed proportion in steady-state operation and the dryer is further provided with a dryer hood capable of variable temperature is improved by controlling adhesive build-up. The improvement includes controlling build-up of an adhesive coating on the drying cylinder by way of stripping at least a portion of the adhesive coating from the drying cylinder with a cleaning doctor while controlling wet-tack to the drying cylinder by way of a technique selected from the group consisting of:

(a) lowering the hood temperature before stripping the coating;

(b) increasing the add-on rate of resinous adhesive above the steady-state add-on rate before stripping the coating.

Typically, wet-tack to the drying cylinder is controlled by combinations of techniques (a) and (b). The resinous adhesive composition may be from about 60% by weight to about 70% by weight PVOH resin during steady rate operation depending upon conditions or the resinous adhesive composition may be from about 75% by weight to about 90% by weight PVOH resin during steady rate operation.

In still yet another aspect of the present invention, the Yankee dryer is provided with a dryer hood capable of variable temperature; controlling build-up of an adhesive coating on the drying cylinder is accomplished by way of intermittently: (a) stripping at least a portion of the adhesive coating from the drying cylinder with a cleaning doctor; and (b) while stripping at least a portion of the adhesive coating from the drying cylinder, controlling the temperature of the dryer such that the temperature of the adhesive coating (measured just above the creping blade, see FIGS. 1,2,3) does not exceed about 300° F. contemporaneously with stripping. Typically, the temperature of the dryer is controlled such that the temperature of the adhesive coating temperature does not exceed about 280° F. contemporaneously with stripping. Maintaining the temperature of the adhesive coating below about 275° F. or 270° F. contemporaneously with stripping is even more preferred. In any case, it is advantageous to lower the temperature of the dryer hood prior to initiating the stripping procedure.

In still another embodiment of the invention, a continuous process for producing absorbent sheet includes:

(a) forming a wet cellulosic web;

(b) at least partially dewatering the web;

(c) adhering the web to a drying cylinder with a resinous adhesive coating composition applied at a substantially constant add-on rate during steady-state operation;

(d) drying the web on the drying cylinder;

(e) peeling the web from the drying cylinder under steady-state tension;

(f) winding the peeled web under steady-state tension to a take-up reel operating at a steady-state speed;

(g) wherein the build-up of adhesive on the drying cylinder is controlled by way of intermittently increasing the add-on rate of resinous adhesive to the drying cylinder above the steady-state add-on rate; and (h) concurrently while the add-on rate of resinous adhesive to the drying cylinder is increased above the steady-state add-on rate, stripping at least a portion of the adhesive coating from the drying cylinder with a cleaning doctor.

The process preferably includes reducing the steady-state tension on the web concurrently with the steps of increasing the resinous adhesive and stripping at least a portion of the coating build-up from the drying cylinder with a cleaning doctor. Immediately after the excess coating is stripped, adhesion of the web to the dryer is visually evaluated (or may be evaluated by other means) prior to increasing the tension to a take up reel and resuming steady-state operation wherein the web is peeled from the drying cylinder.

The web may be at least partially dewatered by way of wet pressing with a felt prior to adhering the web to the drying cylinder or the web may be at least partially dewatered by way of thermal means such as through-drying or impingement air drying prior to adhering the web to a drying cylinder. Optionally, initial dewatering can be carried out by pneumatic means as noted in U.S. patent application Ser. No. 11/167,348 (Publication No. US 2006-0000567), filed on Jun. 27, 2005 entitled "Low Compaction, Pneumatic Dewatering Process for Producing Absorbent Sheet" the disclosure of which is incorporated herein by reference.

Another aspect of the present invention includes a continuous process for producing absorbent sheet including a) forming a wet cellulosic web; b) at least partially dewatering the wet web; c) transferring the partially dewatered web to a textured fabric, such as an impression or throughdrying fabric or a drying fabric; d) texturing the wet web by conforming the web to the textured fabric; e) transferring the wet web to a drying cylinder; f) adhering the web to a drying cylinder with a resinous adhesive coating composition applied to the drying cylinder at a steady-state add-on rate wherein the build-up of adhesive on the drying cylinder is controlled by intermittently cleaning the drying cylinder as noted above. Thus, the present invention is useful in connection with CWP processes, through-drying processes, as well as in a variety of processes where the web is initially compactively dewatered prior to applying the web to the Yankee cylinder.

Still yet another aspect of the invention is directed to an improved process of the class including forming a wet cellulosic web, applying the web onto a drying cylinder of a dryer, which drying cylinder is provided with a resinous adhesive at a substantially constant add-on rate during steady-state operation and accumulating the absorbent sheet on a reel, wherein the improvement comprises controlling build-up of an adhesive coating on the drying cylinder by way of intermittently:

(a) increasing the add-on rate of resinous adhesive to the drying cylinder above the steady-state add-on rate;

(b) segregating the absorbent sheet product produced while the add-on rate of resinous adhesive to the drying cylinder is elevated above the steady-state add-on rate from the absorbent sheet product accumulated on the reel during steady-state operation; and (c) while the add-on rate of adhesion is increased above the steady state add-on rate, stripping at least a portion of the adhesive coating from the drying cylinder with a cleaning doctor; and (d) while the add-on rate of resinous adhesive to the drying cylinder is increased above the steady-state add-on rate, creping the web from the drying cylinder.

Still further aspects and advantages of the present invention will become apparent from the discussion which follows.

BRIEF DESCRIPTION OF DRAWINGS

The invention is described in detail below with reference to the drawings wherein like numbers designate similar parts and wherein.

DETAILED DESCRIPTION

Figure 1:
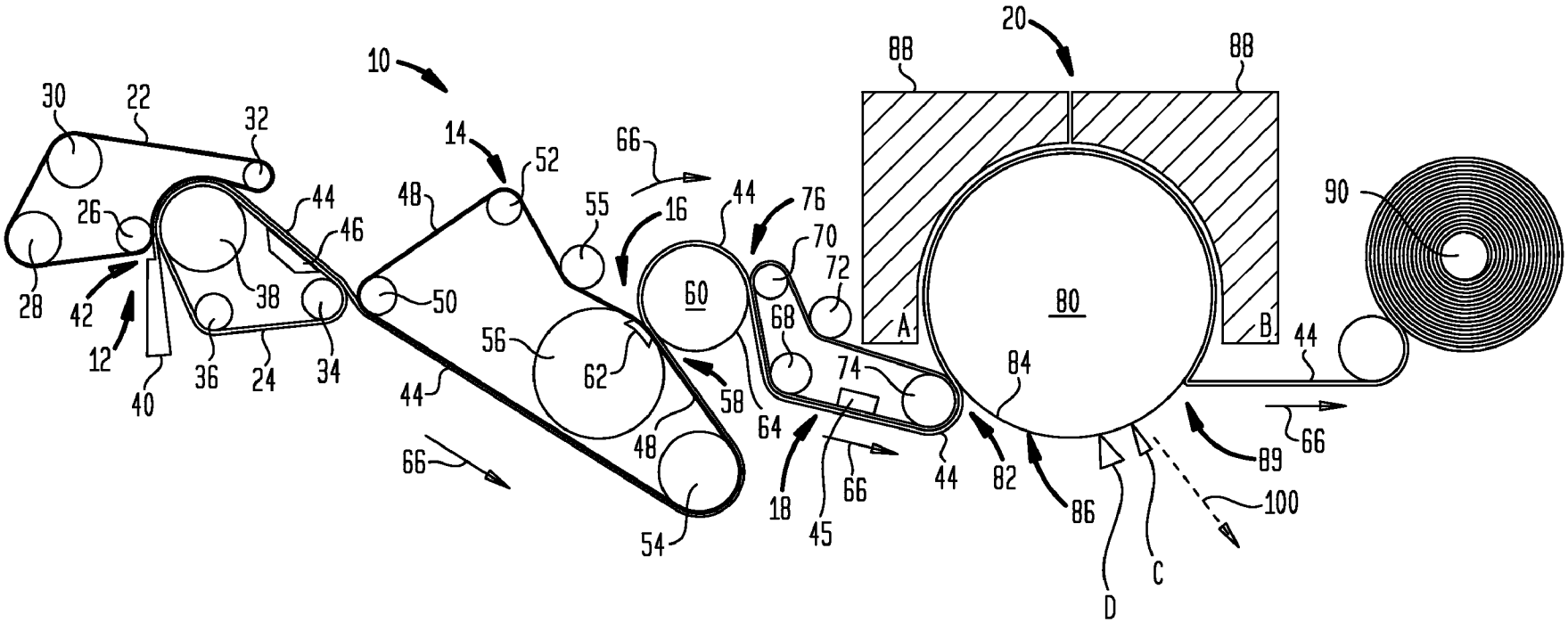
FIG. 1 is a schematic diagram of a first papermachine suitable for practicing the process of the present invention.

The invention is described in detail below with reference to several embodiments and numerous examples. Such discussion is for purposes of illustration only. Modifications to particular examples within the spirit and scope of the present invention, set forth in the appended claims, will be readily apparent to one of skill in the art.

Terminology used herein is given its ordinary meaning consistent with the exemplary definitions set forth immediately below; mg refers to milligrams and $m^2$ refers to square meters and so forth.

The creping adhesive "add-on" rate is calculated by dividing the rate of application of adhesive (mg/min) by surface area of the drying cylinder passing under a spray applicator boom ($m^2$/min). The resinous adhesive composition most preferably consists essentially of a polyvinyl alcohol resin and a polyamide-epichlorohydrin resin wherein the weight ratio of polyvinyl alcohol resin to polyamide-epichlorohydrin resin is from about 2 to about 4. The creping adhesive may also include modifier sufficient to maintain good transfer between the creping fabric and the Yankee cylinder; generally less than 5% by weight modifier and more preferably less than about 2% by weight modifier.

Throughout this specification and claims, when we refer to a nascent web having an apparently random distribution of fiber orientation (or use like terminology), we are referring to the distribution of fiber orientation that results when known forming techniques are used for depositing a furnish on the forming fabric. When examined microscopically, the fibers give the appearance of being randomly oriented even though, depending on the jet to wire speed, there may be a significant bias toward machine direction orientation making the machine direction tensile strength of the web exceed the cross-direction tensile strength.

Unless otherwise specified, "basis weight", BWT, bwt and so forth refers to the weight of a 3000 square foot ream of product. Consistency refers to percent solids of a nascent web, for example, calculated on a bone dry basis. "Air dry" means including residual moisture, by convention up to about 10 percent moisture for pulp and up to about 6% for paper. A nascent web having 50 percent water and 50 percent bone dry pulp has a consistency of 50 percent.

The term "cellulosic", "cellulosic sheet" and the like is meant to include any product incorporating papermaking fiber having cellulose as a major constituent. "Papermaking fibers" include virgin pulps or recycle (secondary) cellulosic fibers or fiber mixes comprising cellulosic fibers. Fibers suitable for making the webs of this invention include: nonwood fibers, such as cotton fibers or cotton derivatives, abaca, kenaf, sabai grass, flax, esparto grass, straw, jute hemp, bagasse, milkweed floss fibers, and pineapple leaf fibers; and wood fibers such as those obtained from deciduous and coniferous trees, including softwood fibers, such as northern and southern softwood kraft fibers; hardwood fibers, such as eucalyptus, maple, birch, aspen, or the like. Papermaking fibers can be liberated from their source material by any one of a number of chemical pulping processes familiar to one experienced in the art including sulfate, sulfite, polysulfide, soda pulping, etc. The pulp can be bleached if desired by chemical means including the use of chlorine, chlorine dioxide, oxygen, alkaline peroxide and so forth. The products of the present invention may comprise a blend of conventional fibers (whether derived from virgin pulp or recycle sources) and high coarseness lignin-rich tubular fibers, such as bleached chemical thermomechanical pulp (BCTMP). "Furnishes" and like terminology refers to aqueous compositions including papermaking fibers, optionally wet strength resins, debonders and the like for making paper products.

As used herein, the term compactively dewatering the web or furnish refers to mechanical dewatering by wet pressing on a dewatering felt, for example, in some embodiments by use of mechanical pressure applied continuously over the web surface as in a nip between a press roll and a press shoe wherein the web is in contact with a papermaking felt. The terminology "compactively dewatering" is used to distinguish processes wherein the initial dewatering of the web is carried out largely by thermal means as is the case, for example, in U.S. Pat. No. 4,529,480 to Trokhan and U.S. Pat. No. 5,607,551 to Farrington et al. Compactively dewatering a web thus refers, for example, to removing water from a nascent web having a consistency of less than 30 percent or so by application of pressure thereto and/or increasing the consistency of the web by about 15 percent or more by application of pressure thereto.

Creping fabric and like terminology refers to a fabric or belt which bears a pattern suitable for practicing the process of the present invention and preferably is permeable enough such that the web may be dried while it is held in the creping fabric. In cases where the web is transferred to another fabric or surface (other than the creping fabric) for drying, the creping fabric may have lower permeability.

Contemporaneous and like terminology refers to occurrences during the same period of time or events occurring with a short period of time, bearing in mind that the entire stripping procedure typically only requires 5-20 minutes.

"Fabric side" and like terminology refers to the side of the web which is in contact with the creping fabric. "Dryer side" or "Yankee side" is the side of the web in contact with the drying cylinder, typically opposite the fabric side of the web.

Fpm refers to feet per minute; while fps refers to feet per second.

MD means machine direction and CD means cross-machine direction.

Nip parameters include, without limitation, nip pressure, nip length, backing roll hardness, fabric approach angle, fabric takeaway angle, uniformity, and velocity delta between surfaces of the nip.

Nip length means the length over which the nip surfaces are in contact.

Removal of an adhesive coating from a drying cylinder is referred to quantitatively here in terms of coating thickness. Thus, removal of a "major portion" of a coating refers to reducing its thickness on the dryer by more than 50%.

Figure 2:
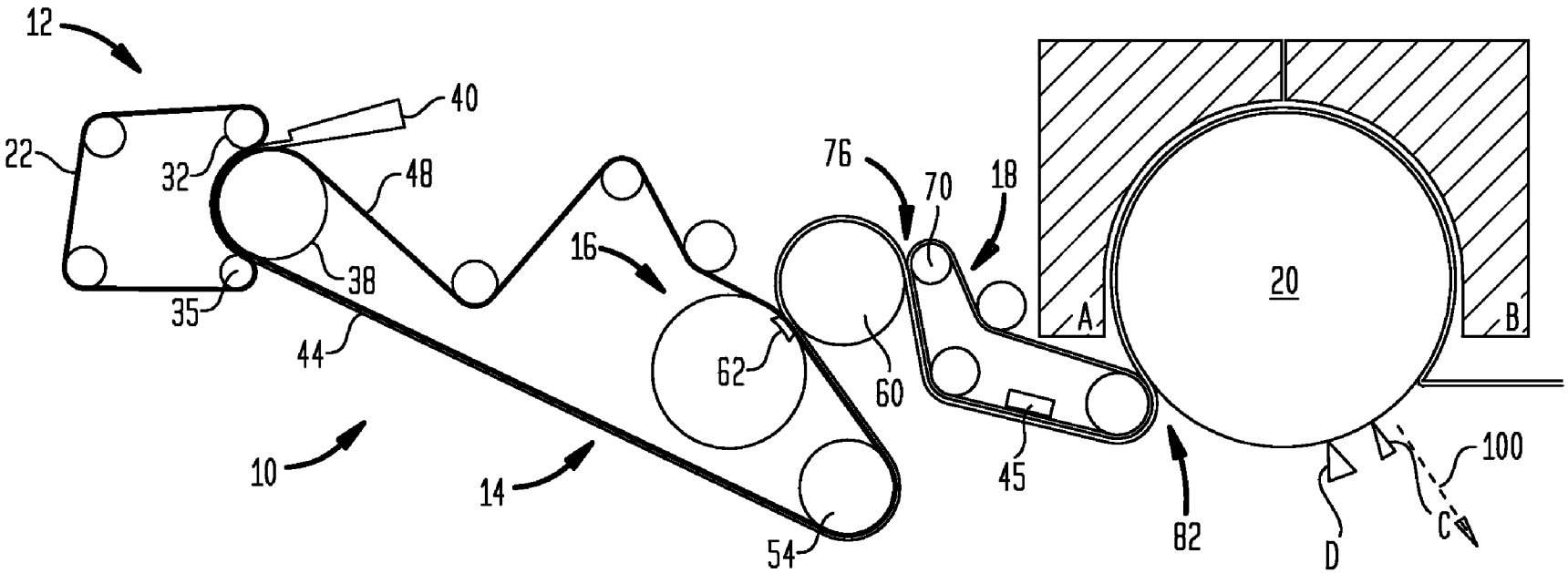
FIG. 2 is a schematic diagram of a second papermachine suitable for practicing the present invention.
Figure 3:
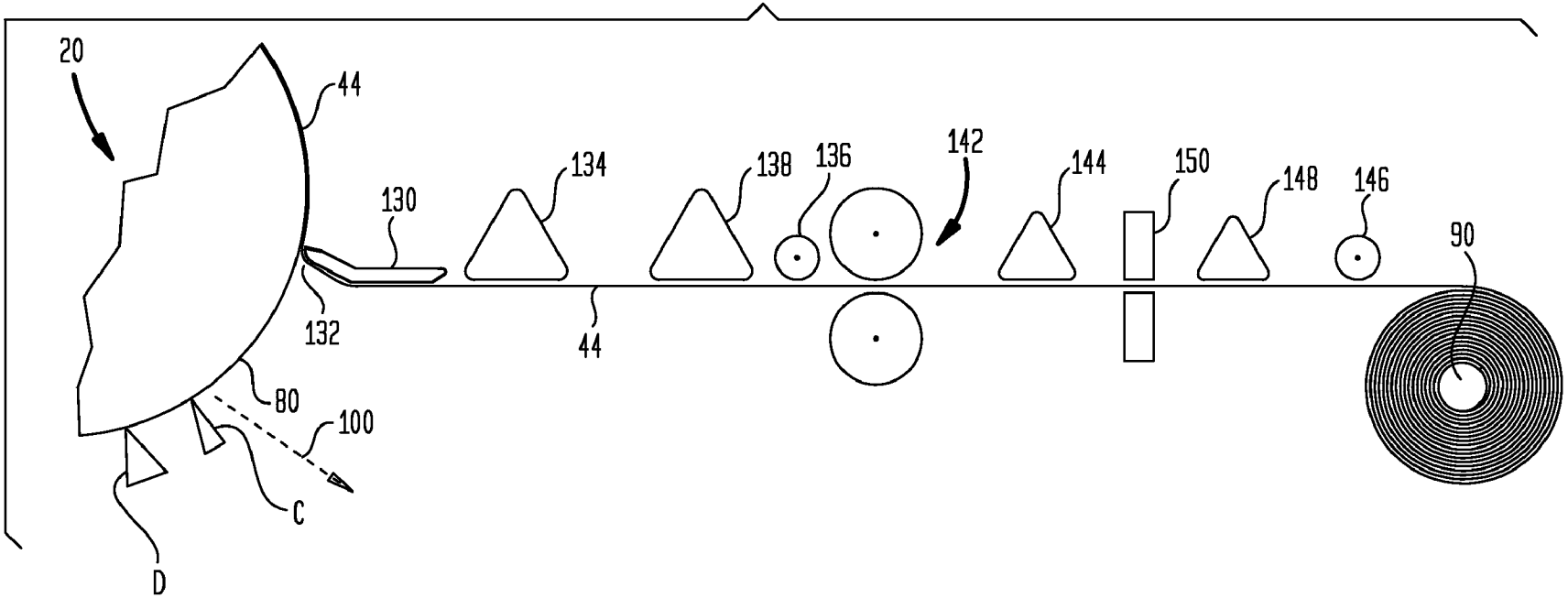
FIG. 3 is a schematic diagram illustrating the optional use of air foils in connection with the present invention.

When we refer to the adhesive coating temperature, we are referring to the coating temperature on the Yankee dryer at its downstream portion, typically at a location just above the creping blade shown on FIGS. 1,2 and 3 unless otherwise indicated. This temperature is conveniently measured with an infra-red probe and is roughly equal to the temperature of the Yankee cylinder surface at the point where the product is removed therefrom.

A translating transfer surface refers to the surface from which the web is creped into the creping fabric. The translating transfer surface may be the surface of a rotating drum as described hereafter, or may be the surface of a continuous smooth moving belt or another moving fabric which may have surface texture and so forth. The translating transfer surface needs to support the web and facilitate the high solids creping as will be appreciated from the discussion which follows.

"Wet-tack" refers generally to the ability of an adhesive coating on a drying cylinder to adhere a wet web to the cylinder for purposes of drying the web.

Calipers and or bulk reported herein may be measured at 8 or 16 sheet calipers as specified. The sheets are stacked and the caliper measurement taken about the central portion of the stack. Preferably, the test samples are conditioned in an atmosphere of 23°±1.0° C. (73.4°±1.8° F.) at 50% relative humidity for at least about 2 hours and then measured with a Thwing-Albert Model 89-II-JR or Progage Electronic Thickness Tester with 2-in (50.8-mm) diameter anvils, 539±10 grams dead weight load, and 0.231 in./sec descent rate. For finished product testing, each sheet of product to be tested must have the same number of plies as the product is sold. For testing in general, eight sheets are selected and stacked together. For napkin testing, napkins are unfolded prior to stacking. For basesheet testing off of winders, each sheet to be tested must have the same number of plies as produced off the winder. For basesheet testing off of the papermachine reel, single plies must be used. Sheets are stacked together aligned in the MD. On custom embossed or printed product, try to avoid taking measurements in these areas if at all possible. Bulk may also be expressed in units of volume/weight by dividing caliper by basis weight.

Bending length (cm) is determined in accordance with ASTM test method D 1388-96, cantilever option.

Water absorbency rate or WAR, is measured in seconds and is the time it takes for a sample to absorb a 0.1 gram droplet of water disposed on its surface by way of an automated syringe. The test specimens are preferably conditioned at 23° C.±1° C. (73.4±1.8° F.) at 50% relative humidity. For each sample, 4 3×3 inch test specimens are prepared. Each specimen is placed in a sample holder such that a high intensity lamp is directed toward the specimen. 0.1 ml of water is deposited on the specimen surface and a stop watch is started. When the water is absorbed, as indicated by lack of further reflection of light from the drop, the stopwatch is stopped and the time recorded to the nearest 0.1 seconds. The procedure is repeated for each specimen and the results averaged for the sample. WAR is measured in accordance with TAPPI method T-432 cm-99.

Dry tensile strengths (MD and CD), stretch, ratios thereof, modulus, break modulus, stress and strain are measured with a standard Instron test device or other suitable elongation tensile tester which may be configured in various ways, typically using 3 or 1 inch wide strips of tissue or towel, conditioned in an atmosphere of 23°±1° C. (73.4°±1° F.) at 50% relative humidity for 2 hours. The tensile test is run at a crosshead speed of 2 in/min. Break modulus is expressed in grams/3 inches/% strain. % strain is dimensionless and need not be specified.

Tensile ratios are simply ratios of the values determined by way of the foregoing methods. Unless otherwise specified, a tensile property is a dry sheet property.

The wet tensile of the tissue of the present invention is measured using a three-inch wide strip of tissue that is folded into a loop, clamped in a special fixture termed a Finch Cup, then immersed in a water. The Finch Cup, which is available from the Thwing-Albert Instrument Company of Philadelphia, Pa., is mounted onto a tensile tester equipped with a 2.0 pound load cell with the flange of the Finch Cup clamped by the tester's lower jaw and the ends of tissue loop clamped into the upper jaw of the tensile tester. The sample is immersed in water that has been adjusted to a pH of 7.0+−0.1 and the tensile is tested after a 5 second immersion time. The results are expressed in g/3", dividing by two to account for the loop as appropriate.

"Fabric crepe ratio" is an expression of the speed differential between the creping fabric and the forming wire and typically calculated as the ratio of the web speed immediately before fabric creping and the web speed immediately following fabric creping, the forming wire and transfer surface being typically, but not necessarily, operated at the same speed:

$$\text{Fabric crepe ratio} = \text{transfer cylinder speed} \div \text{creping fabric speed}$$

Fabric crepe can also be expressed as a percentage calculated as:

$$\text{Fabric crepe,percent,} = [\text{Fabric crepe ratio} - 1] \times 100\%$$

A web creped from a transfer cylinder with a surface speed of 750 fpm to a fabric with a velocity of 500 fpm has a fabric crepe ratio of 1.5 and a fabric crepe of 50%.

The total crepe ratio is calculated as the ratio of the forming wire speed to the reel speed and a % total crepe is:

$$\text{Total Crepe \%} = [\text{Total Crepe Ratio} - 1] \times 100\%$$

A process with a forming wire speed of 2000 fpm and a reel speed of 1000 fpm has a line or total crepe ratio of 2 and a total crepe of 100%.

PLI or pli means pounds force per linear inch.

Pusey and Jones (P&J) hardness (indentation) is measured in accordance with ASTM D 531, and refers to the indentation number (standard specimen and conditions).

A "steady-state" parameter is preferably relatively constant during a manufacturing campaign and refers to the value of the parameter between (and exclusive of) operations where build-up of adhesive is removed from a drying cylinder in accordance with the present invention. If add-on, tensions and so forth vary during operation between cleaning operations, the time averaged value between (and exclusive of) cleaning operations is used as the steady-state value.

Velocity delta means a difference in linear speed.

The creping adhesive used to secure the web to the Yankee drying cylinder is preferably a hygroscopic, re-wettable, substantially non-crosslinking adhesive. Examples of preferred adhesives are those which include poly(vinyl alcohol) of the general class described in U.S. Pat. No. 4,528,316 to Soerens et al. Other suitable adhesives are disclosed in U.S. Provisional Patent Application Ser. No. 60/372,255, filed Apr. 12, 2002, entitled "Improved Creping Adhesive Modifier and Process for Producing Paper Products" . The disclosures of the '316 patent and the '255 application are incorporated herein by reference. Suitable adhesives are optionally provided with modifiers and so forth. It is preferred to use crosslinker and/or modifier sparingly or not at all in the adhesive.

Creping adhesives may comprise a thermosetting or non-thermosetting resin, a film-forming semi-crystalline polymer and optionally an inorganic cross-linking agent as well as modifiers. Optionally, the creping adhesive of the present invention may also include other components, including, but not limited to, hydrocarbons oils, surfactants, or plasticizers.

Creping modifiers which may be used in limited amounts include a quaternary ammonium complex comprising at least one non-cyclic amide. The quaternary ammonium complex may also contain one or several nitrogen atoms (or other atoms) that are capable of reacting with alkylating or quaternizing agents. These alkylating or quaternizing agents may contain zero, one, two, three or four non-cyclic amide containing groups. An amide containing group is represented by the following formula structure:

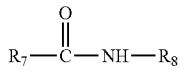

where $R_7$ and $R_8$ are non-cyclic molecular chains of organic or inorganic atoms.

Preferred non-cyclic bis-amide quaternary ammonium complexes with non-cyclic amide functionality can be of the formula:

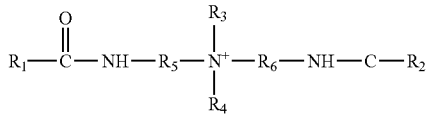

where $R_1$ and $R_2$ can be long chain non-cyclic saturated or unsaturated aliphatic groups; $R_3$ and $R_4$ can be long chain non-cyclic saturated or unsaturated aliphatic groups, a halogen, a hydroxide, an alkoxylated fatty acid, an alkoxylated fatty alcohol, a polyethylene oxide group, or an organic alcohol group; and $R_5$ and $R_6$ can be long chain non-cyclic saturated or unsaturated aliphatic groups. The modifier is optionally present in the creping adhesive in an amount of from about 0.05% to about 25%, more preferably from about 0.25% to about 10%, and most preferably from about 0.5% to about 5% based on the total solids of the creping adhesive composition.

Modifiers include those obtainable from Goldschmidt Corporation of Essen/Germany or Process Application Corporation based in Washington Crossing, Pa. Appropriate creping modifiers from Goldschmidt Corporation include, but are not limited to, VARISOFT®0 222LM, VARISOFT® 222, VARISOFT® 110, VARISOFT® 222LT, VARISOFT® 110 DEG, and VARISOFT® 238. Appropriate creping modifiers from Process Application Corporation include, but are not limited to, PALSOFT 580 FDA or PALSOFT 580C.

Other creping modifiers for use in the present invention include, but are not limited to, those compounds as described in WO/01/85109, which is incorporated herein by reference in its entirety.

Creping adhesives for use in connection with to the present invention may include any suitable thermosetting or non-thermosetting resin. Resins according to the present invention are preferably chosen from thermosetting and non-thermosetting polyamide resins or glyoxylated polyacrylamide resins. Polyamides for use in the present invention can be branched or unbranched, saturated or unsaturated.

Polyamide resins for use in the present invention may include polyamide-epihalohydrin resins such as polyaminoamide-epichlorohydrin (PAE) resins of the same general type employed as wet strength resins. PAE resins are described, for example, in "Wet-Strength Resins and Their Applications," Ch. 2, H. Epsy entitled Alkaline-Curing Polymeric Amine-Epichlorohydrin Resins, which is incorporated herein by reference in its entirety. Preferred PAE resins for use according to the present invention include a water-soluble polymeric reaction product of an epihalohydrin, preferably epichlorohydrin, and a water-soluble polyamide having secondary amine groups derived from a polyalkylene polyamine and a saturated aliphatic dibasic carboxylic acid containing from about 3 to about 10 carbon atoms.

A non-exhaustive list of non-thermosetting cationic polyamide resins can be found in U.S. Pat. No. 5,338,807, issued to Espy et al. and incorporated herein by reference. The non-thermosetting resin may be synthesized by directly reacting the polyamides of a dicarboxylic acid and methyl bis(3-aminopropyl)amine in an aqueous solution, with epichlorohydrin. The carboxylic acids can include saturated and unsaturated dicarboxylic acids having from about 2 to 12 carbon atoms, including for example, oxalic, malonic, succinic, glutaric, adipic, pilemic, suberic, azelaic, sebacic, maleic, itaconic, phthalic, and terephthalic acids. Adipic and glutaric acids are preferred, with adipic acid being the most preferred. The esters of the aliphatic dicarboxylic acids and aromatic dicarboxylic acids, such as the phathalic acid, may be used, as well as combinations of such dicarboxylic acids or esters. The preparation of water soluble, thermosetting polyamide-epihalohydrin resin is described in U.S. Pat. Nos. 2,926,116; 3,058,873; and 3,772,076 issued to Kiem, all of which are incorporated herein by reference in their entirety.

The polyamide resin may be based on DETA instead of a generalized polyamine. Two examples of structures of such a polyamide resin are given below. Structure 1 shows two types of end groups: a di-acid and a mono-acid based group:

STRUCTURE 1

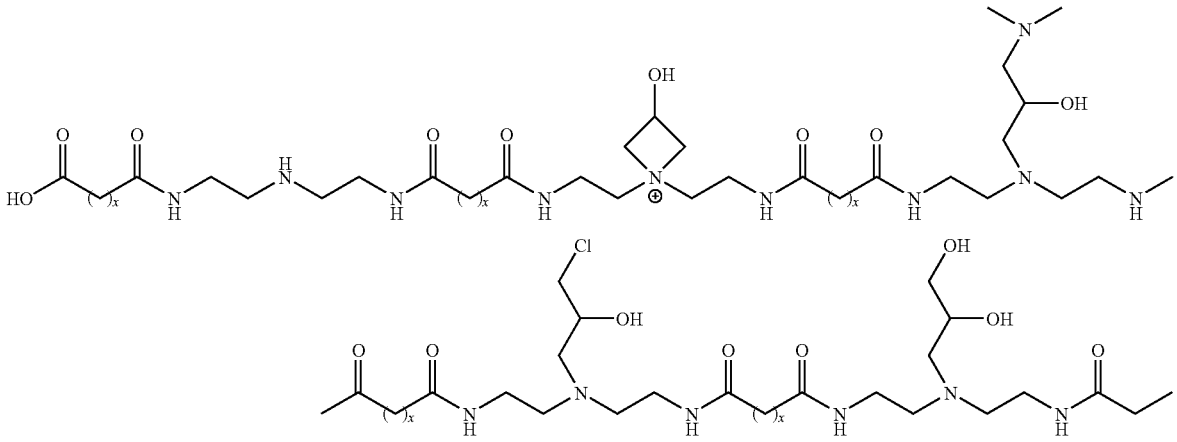

Structure 2 shows a polymer with one end-group based on a di-acid group and the other end-group based on a nitrogen group:

STRUCTURE 2

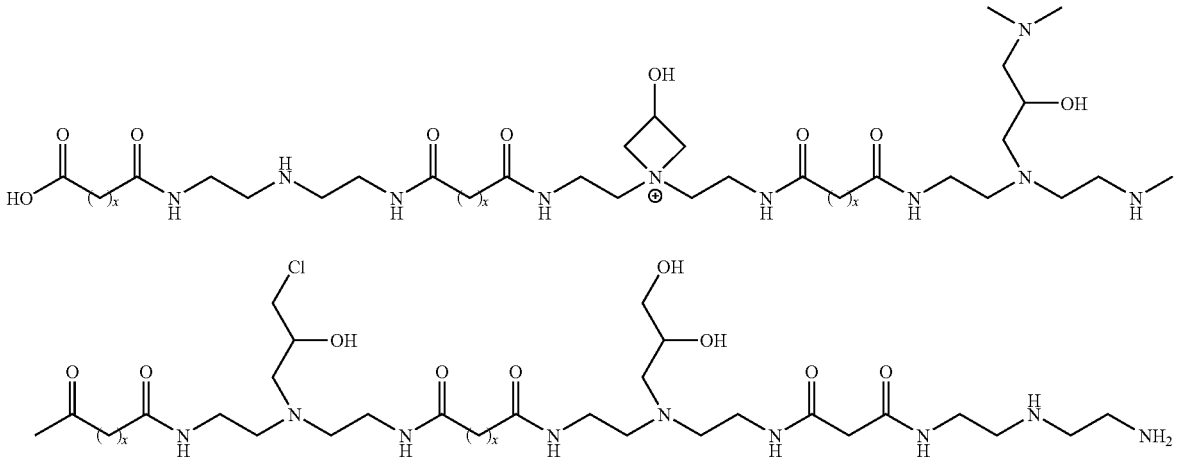

Note that although both structures are based on DETA, other polyamines may be used to form this polymer, including those, which may have tertiary amide side chains.

The polyamide resin has a viscosity of from about 80 to about 800 centipoise and a total solids of from about 5% to about 40%. The polyamide resin is present in the creping adhesive according to the present invention in an amount of from about 0% to about 99.5%. According to another embodiment, the polyamide resin is present in the creping adhesive in an amount of from about 20% to about 80%. In yet another embodiment, the polyamide resin is present in the creping adhesive in an amount of from about 40% to about 60% based on the total solids of the creping adhesive composition.

Polyamide resins for use according to the present invention can be obtained from Ondeo-Nalco Corporation, based in Naperville, Ill., and Hercules Corporation, based in Wilmington, Del. Creping adhesive resins for use according to the present invention from Ondeo-Nalco Corporation include, but are not limited to, CREPECCEL® 675NT, CREPECCEL® 675P and CREPECCEL® 690HA. Appropriate creping adhesive resins available from Hercules Corporation include, but are not limited to, HERCULES 82-176, HERCULES 1145, Unisoft 805 and CREPETROL A-6115. Other polyamide resins for use according to the present invention include, for example, those described in U.S. Pat. Nos. 5,961,782 and 6,133,405, both of which are incorporated herein by reference.

The creping adhesive also includes a film-forming semi-crystalline polymer. Film-forming semi-crystalline polymers for use in the present invention can be selected from, for example, hemicellulose, carboxymethyl cellulose, and most preferably includes polyvinyl alcohol (PVOH). Polyvinyl alcohols used in the creping adhesive can have an average molecular weight of about 13,000 to about 124,000 daltons. According to one embodiment, the polyvinyl alcohols have a degree of hydrolysis of from about 80% to about 99.9%. According to another embodiment, polyvinyl alcohols have a degree of hydrolysis of from about 85% to about 95%. In yet another embodiment, polyvinyl alcohols have a degrees of hydrolysis of from about 86% to about 90%. Also, according to one embodiment, polyvinyl alcohols preferably have a viscosity, measured at 20 degree centigrade using a 4% aqueous solution, of from about 2 to about 100 centipoise. According to another embodiment, polyvinyl alcohols have a viscosity of from about 10 to about 70 centipoise. In yet another embodiment, polyvinyl alcohols have a viscosity of from about 20 to about 50 centipoise.

Typically, the polyvinyl alcohol is present in the creping adhesive in an amount of from about 10% to 90% or 20% to about 80% or more. In some embodiments, the polyvinyl alcohol is present in the creping adhesive in an amount of from about 40% to about 60%, by weight, based on the total solids of the creping adhesive composition.

Polyvinyl alcohols for use according to the present invention include those obtainable from Monsanto Chemical Co. and Celanese Chemical. Appropriate polyvinyl alcohols from Monsanto Chemical Co. include Gelvatols, including, but not limited to, GELVATOL 1-90, GELVATOL 3-60, GELVATOL 20-30, GELVATOL 1-30, GELVATOL 20-90, and GELVATOL 20-60. Regarding the Gelvatols, the first number indicates the percentage residual polyvinyl acetate and the next series of digits when multiplied by 1,000 gives the number corresponding to the average molecular weight. Generally, polyvinyl alcohol or PVOH resins consist mostly of hydrolyzed polyvinyl acetate repeat units (more than 50 mole %), but may include monomers other than polyvinyl acetate in amounts up to about 10 mole % or so in typical commercial resins.

Celanese Chemical polyvinyl alcohol products for use in the creping adhesive (previously named Airvol products from Air Products until October 2000) are listed below:

TABLE 1

| Polyvinyl Alcohol for Creping Adhesive | | | | | |
|---|---|---|---|---|---|
| Grade | % Hydrolysis, | Viscosity, cps[1] | pH | Volatiles, % Max. | Ash, % Max.[3] |
| Super Hydrolyzed | | | | | |
| Celvol 125 | 99.3+ | 28-32 | 5.5-7.5 | 5 | 1.2 |
| Celvol 165 | 99.3+ | 62-72 | 5.5-7.5 | 5 | 1.2 |
| Fully Hydrolyzed | | | | | |
| Celvol 103 | 98.0-98.8 | 3.5-4.5 | 5.0-7.0 | 5 | 1.2 |
| Celvol 305 | 98.0-98.8 | 4.5-5.5 | 5.0-7.0 | 5 | 1.2 |
| Celvol 107 | 98.0-98.8 | 5.5-6.6 | 5.0-7.0 | 5 | 1.2 |
| Celvol 310 | 98.0-98.8 | 9.0-11.0 | 5.0-7.0 | 5 | 1.2 |
| Celvol 325 | 98.0-98.8 | 28.0-32.0 | 5.0-7.0 | 5 | 1.2 |
| Celvol 350 | 98.0-98.8 | 62-72 | 5.0-7.0 | 5 | 1.2 |
| Intermediate Hydrolyzed | | | | | |
| Celvol 418 | 91.0-93.0 | 14.5-19.5 | 4.5-7.0 | 5 | 0.9 |
| Celvol 425 | 95.5-96.5 | 27-31 | 4.5-6.5 | 5 | 0.9 |
| Partially Hydrolyzed | | | | | |
| Celvol 502 | 87.0-89.0 | 3.0-3.7 | 4.5-6.5 | 5 | 0.9 |
| Celvol 203 | 87.0-89.0 | 3.5-4.5 | 4.5-6.5 | 5 | 0.9 |
| Celvol 205 | 87.0-89.0 | 5.2-6.2 | 4.5-6.5 | 5 | 0.7 |
| Celvol 513 | 86.0-89.0 | 13-15 | 4.5-6.5 | 5 | 0.7 |
| Celvol 523 | 87.0-89.0 | 23-27 | 4.0-6.0 | 5 | 0.5 |
| Celvol 540 | 87.0-89.0 | 45-55 | 4.0-6.0 | 5 | 0.5 |

[1]4% aqueous solution, 20° C.

The creping adhesive may also comprise one or more inorganic cross-linking salts or agents. Such additives are believed best used sparingly or not at all in connection with the present invention. A non-exhaustive list of multivalent metal ions includes calcium, barium, titanium, chromium, manganese, iron, cobalt, nickel, zinc, molybdenum, tin, antimony, niobium, vanadium, tungsten, selenium, and zirconium. Mixtures of metal ions can be used. Preferred anions include acetate, formate, hydroxide, carbonate, chloride, bromide, iodide, sulfate, tartrate, and phosphate. An example of a preferred inorganic cross-linking salt is a zirconium salt. The zirconium salt for use according to one embodiment of the present invention can be chosen from one or more zirconium compounds having a valence of plus four, such as ammonium zirconium carbonate, zirconium acetylacetonate, zirconium acetate, zirconium carbonate, zirconium sulfate, zirconium phosphate, potassium zirconium carbonate, zirconium sodium phosphate, and sodium zirconium tartrate. Appropriate zirconium compounds include, for example, those described in U.S. Pat. No. 6,207,011, which is incorporated herein by reference.

The inorganic cross-linking salt can be present in the creping adhesive in an amount of from about 0% to about 30%. In another embodiment, the inorganic cross-linking agent can be present in the creping adhesive in an amount of from about 1% to about 20%. In yet another embodiment, the inorganic cross-linking salt can be present in the creping adhesive in an amount of from about 1% to about 10% by weight based on the total solids of the creping adhesive composition. Zirconium compounds for use according to the present invention include those obtainable from EKA Chemicals Co. (previously Hopton Industries) and Magnesium Elektron, Inc. Appropriate commercial zirconium compounds from EKA Chemicals Co. are AZCOTE 5800M and KZCOTE 5000 and from Magnesium Elektron, Inc. are AZC or KZC.

As noted above, the creping adhesive can include any other components, including, but not limited to, organic cross-linkers, hydrocarbon oils, surfactants, amphoterics, humectants, plasticizers, or other surface treatment agents. An extensive, but non-exhaustive, list of organic cross-linkers includes glyoxal, maleic anhydride, bismaleimide, bis acrylamide, and epihalohydrin. The organic cross-linkers can be cyclic or non-cyclic compounds. Plastizers for use in the present invention can include propylene glycol, diethylene glycol, triethylene glycol, dipropylene glycol, and glycerol.

The creping adhesive may be applied as a single composition or may be applied in its component parts. More particularly, the polyamide resin may be applied separately from the polyvinyl alcohol (PVOH) and the modifier.

When using a creping blade, a normal coating package is applied at a total coating rate (add-on as calculated above) of 54 mg/m$^2$ with 32 mg/m$^2$ of PVOH (Celvol 523)/11.3 mg/m$^2$ of PAE (Hercules 1145) and 10.5 mg/m$^2$ of modifier (Hercules 4609VF). A preferred coating for a peeling process may be applied at a rate of 20 mg/m$^2$ with 14.52 mg/m$^2$ of PVOH (Celvol 523)/5.10 mg/m$^2$ of PAE (Hercules 1145) and 0.38 mg/m$^2$ of modifier (Hercules 4609VF).

In connection with the present invention, an absorbent paper web is made by dispersing papermaking fibers into aqueous furnish (slurry) and depositing the aqueous furnish onto the forming wire of a papermaking machine. Any suitable forming scheme might be used. For example, an extensive but non-exhaustive list in addition to Fourdrinier formers includes a crescent former, a C-wrap twin wire former, an S-wrap twin wire former, or a suction breast roll former. The forming fabric can be any suitable foraminous member including single layer fabrics, double layer fabrics, triple layer fabrics, photopolymer fabrics, and the like. Non-exhaustive background art in the forming fabric area includes U.S. Pat. Nos. 4,157,276; 4,605,585; 4,161,195; 3,545,705; 3,549,742; 3,858,623; 4,041,989; 4,071,050; 4,112,982; 4,149,571; 4,182,381; 4,184,519; 4,314,589; 4,359,069; 4,376,455; 4,379,735; 4,453,573; 4,564,052; 4,592,395; 4,611,639; 4,640,741; 4,709,732; 4,759,391; 4,759,976;

4,942,077; 4,967,085; 4,998,568; 5,016,678; 5,054,525; 5,066,532; 5,098,519; 5,103,874; 5,114,777; 5,167,261; 5,199,261; 5,199,467; 5,211,815; 5,219,004; 5,245,025; 5,277,761; 5,328,565; and 5,379,808 all of which are incorporated herein by reference in their entirety. One forming fabric particularly useful with the present invention is Voith Fabrics Forming Fabric 2164 made by Voith Fabrics Corporation, Shreveport, La.

Foam-forming of the aqueous furnish on a forming wire or fabric may be employed as a means for controlling the permeability or void volume of the sheet upon fabric-creping. Foam-forming techniques are disclosed in U.S. Pat. No. 4,543,156 and Canadian Patent No. 2,053,505, the disclosures of which are incorporated herein by reference. The foamed fiber furnish is made up from an aqueous slurry of fibers mixed with a foamed liquid carrier just prior to its introduction to the headbox. The pulp slurry supplied to the system has a consistency in the range of from about 0.5 to about 7 weight percent fibers, preferably in the range of from about 2.5 to about 4.5 weight percent. The pulp slurry is added to a foamed liquid comprising water, air and surfactant containing 50 to 80 percent air by volume forming a foamed fiber furnish having a consistency in the range of from about 0.1 to about 3 weight percent fiber by simple mixing from natural turbulence and mixing inherent in the process elements. The addition of the pulp as a low consistency slurry results in excess foamed liquid recovered from the forming wires. The excess foamed liquid is discharged from the system and may be used elsewhere or treated for recovery of surfactant therefrom.

The furnish may contain chemical additives to alter the physical properties of the paper produced. These chemistries are well understood by the skilled artisan and may be used in any known combination. Such additives may be surface modifiers, softeners, debonders, strength aids, latexes, opacifiers, optical brighteners, dyes, pigments, sizing agents, barrier chemicals, retention aids, insolubilizers, organic or inorganic crosslinkers, or combinations thereof; said chemicals optionally comprising polyols, starches, PPG esters, PEG esters, phospholipids, surfactants, polyamines, HMCP (Hydrophobically Modified Cationic Polymers), HMAP (Hydrophobically Modified Anionic Polymers) or the like.

The pulp can be mixed with strength adjusting agents such as wet strength agents, dry strength agents and debonders/softeners and so forth. Suitable wet strength agents are known to the skilled artisan. A comprehensive but non-exhaustive list of useful strength aids include urea-formaldehyde resins, melamine formaldehyde resins, glyoxylated polyacrylamide resins, polyamide-epichlorohydrin resins and the like. Thermosetting polyacrylamides are produced by reacting acrylamide with diallyl dimethyl ammonium chloride (DADMAC) to produce a cationic polyacrylamide copolymer which is ultimately reacted with glyoxal to produce a cationic cross-linking wet strength resin, glyoxylated polyacrylamide. These materials are generally described in U.S. Pat. Nos. 3,556,932 to Coscia et al. and 3,556,933 to Williams et al., both of which are incorporated herein by reference in their entirety. Resins of this type are commercially available under the trade name of PAREZ 631NC by Bayer Corporation. Different mole ratios of acrylamide/-DADMAC/glyoxal can be used to produce cross-linking resins, which are useful as wet strength agents. Furthermore, other dialdehydes can be substituted for glyoxal to produce thermosetting wet strength characteristics. Of particular utility are the polyamide-epichlorohydrin wet strength resins, an example of which is sold under the trade names Kymene 557LX and Kymene 557H by Hercules Incorporated of Wilmington, Del. and Amres® from Georgia-Pacific Resins, Inc. These resins and the process for making the resins are described in U.S. Pat. No. 3,700,623 and U.S. Pat. No. 3,772,076 each of which is incorporated herein by reference in its entirety. An extensive description of polymeric-epihalohydrin resins is given in Chapter 2: *Alkaline-Curing Polymeric Amine-Epichlorohydrin* by Espy in *Wet Strength Resins and Their Application* (L. Chan, Editor, 1994), herein incorporated by reference in its entirety. A reasonably comprehensive list of wet strength resins is described by Westfelt in *Cellulose Chemistry and Technology* Volume 13, p. 813, 1979, which is incorporated herein by reference.

Suitable temporary wet strength agents may likewise be included, particularly in special applications where disposable towel with permanent wet strength resin is to be avoided. A comprehensive but non-exhaustive list of useful temporary wet strength agents includes aliphatic and aromatic aldehydes including glyoxal, malonic dialdehyde, succinic dialdehyde, glutaraldehyde and dialdehyde starches, as well as substituted or reacted starches, disaccharides, polysaccharides, chitosan, or other reacted polymeric reaction products of monomers or polymers having aldehyde groups, and optionally, nitrogen groups. Representative nitrogen containing polymers, which can suitably be reacted with the aldehyde containing monomers or polymers, includes vinyl-amides, acrylamides and related nitrogen containing polymers. These polymers impart a positive charge to the aldehyde containing reaction product. In addition, other commercially available temporary wet strength agents, such as, PAREZ 745, manufactured by Bayer can be used, along with those disclosed, for example in U.S. Pat. No. 4,605,702.

The temporary wet strength resin may be any one of a variety of water-soluble organic polymers comprising aldehydic units and cationic units used to increase dry and wet tensile strength of a paper product. Such resins are described in U.S. Pat. Nos. 4,675,394; 5,240,562; 5,138,002; 5,085,736; 4,981,557; 5,008,344; 4,603,176; 4,983,748; 4,866,151; 4,804,769 and 5,217,576. Modified starches sold under the trademarks CO-BOND® 1000 and CO-BOND® 1000 Plus, by National Starch and Chemical Company of Bridgewater, N.J. may be used. Prior to use, the cationic aldehydic water soluble polymer can be prepared by preheating an aqueous slurry of approximately 5% solids maintained at a temperature of approximately 240° Fahrenheit and a pH of about 2.7 for approximately 3.5 minutes. Finally, the slurry can be quenched and diluted by adding water to produce a mixture of approximately 1.0% solids at less than about 130° Fahrenheit.

Other temporary wet strength agents, also available from National Starch and Chemical Company are sold under the trademarks CO-BOND® 1600 and CO-BOND® 2300. These starches are supplied as aqueous colloidal dispersions and do not require preheating prior to use.

Temporary wet strength agents such as glyoxylated polyacrylamide can be used. Temporary wet strength agents such glyoxylated polyacrylamide resins are produced by reacting acrylamide with diallyl dimethyl ammonium chloride (DADMAC) to produce a cationic polyacrylamide copolymer which is ultimately reacted with glyoxal to produce a cationic cross-linking temporary or semi-permanent wet strength resin, glyoxylated polyacrylamide. These materials are generally described in U.S. Pat. No. 3,556,932 to Coscia et al. and U.S. Pat. No. 3,556,933 to Williams et al., both of which are incorporated herein by reference. Resins of this type are commercially available under the trade name of PAREZ 631NC, by Bayer Industries. Different mole ratios of acrylamide/DADMAC/glyoxal can be used to produce cross-linking resins, which are useful as wet strength agents. Furthermore, other dialdehydes can be substituted for glyoxal to produce wet strength characteristics.

Suitable dry strength agents include starch, guar gum, polyacrylamides, carboxymethyl cellulose and the like. Of particular utility is carboxymethyl cellulose, an example of which is sold under the trade name Hercules CMC, by Hercules Incorporated of Wilmington, Del. According to one embodiment, the pulp may contain from about 0 to about 15 lb/ton of dry strength agent. According to another embodiment, the pulp may contain from about 1 to about 5 lbs/ton of dry strength agent.

Suitable debonders are likewise known to the skilled artisan. Debonders or softeners may also be incorporated into the pulp or sprayed upon the web after its formation. The present invention may also be used with softener materials including but not limited to the class of amido amine salts derived from partially acid neutralized amines. Such materials are disclosed in U.S. Pat. No. 4,720,383. Evans, *Chemistry and Industry,* 5 Jul. 1969, pp. 893-903; Egan, *J. Am. Oil Chemist's Soc.*, Vol. 55 (1978), pp. 118-121; and Trivedi et al., *J. Am. Oil Chemist's Soc.*, June 1981, pp. 754-756, incorporated by reference in their entirety, indicate that softeners are often available commercially only as complex mixtures rather than as single compounds. While the following discussion will focus on the predominant species, it should be understood that commercially available mixtures would generally be used in practice.

Quasoft 202-JR is a suitable softener material, which may be derived by alkylating a condensation product of oleic acid and diethylenetriamine. Synthesis conditions using a deficiency of alkylation agent (e.g., diethyl sulfate) and only one alkylating step, followed by pH adjustment to protonate the non-ethylated species, result in a mixture consisting of cationic ethylated and cationic non-ethylated species. A minor proportion (e.g., about 10%) of the resulting amido amine cyclize to imidazoline compounds. Since only the imidazoline portions of these materials are quaternary ammonium compounds, the compositions as a whole are pH-sensitive. Therefore, in the practice of the present invention with this class of chemicals, the pH in the head box should be approximately 6 to 8, more preferably 6 to 7 and most preferably 6.5 to 7.

Quaternary ammonium compounds, such as dialkyl dimethyl quaternary ammonium salts are also suitable particularly when the alkyl groups contain from about 10 to 24 carbon atoms. These compounds have the advantage of being relatively insensitive to pH.

Biodegradable softeners can be utilized. Representative biodegradable cationic softeners/debonders are disclosed in U.S. Pat. Nos. 5,312,522; 5,415,737; 5,262,007; 5,264,082; and 5,223,096, all of which are incorporated herein by reference in their entirety. The compounds are biodegradable diesters of quaternary ammonia compounds, quaternized amine-esters, and biodegradable vegetable oil based esters functional with quaternary ammonium chloride and diester dierucyldimethyl ammonium chloride and are representative biodegradable softeners.

In some embodiments, a particularly preferred debonder composition includes a quaternary amine component as well as a nonionic surfactant.

The nascent web may be compactively dewatered on a papermaking felt. Any suitable felt may be used. For example, felts can have double-layer base weaves, triple-layer base weaves, or laminated base weaves. Preferred felts are those having the laminated base weave design. A wet-press-felt which may be particularly useful with the present invention is Vector 3 made by Voith Fabric. Background art in the press felt area includes U.S. Pat. Nos. 5,657,797; 5,368,696; 4,973,512; 5,023,132; 5,225,269; 5,182,164; 5,372,876; and 5,618,612. A differential pressing felt as is disclosed in U.S. Pat. No. 4,533,437 to Curran et al. may likewise be utilized.

Suitable creping or textured fabrics include single layer, multi-layer, or composite preferably open meshed structures. Fabrics may have at least one of the following characteristics: (1) on the side of the creping fabric that is in contact with the wet web (the "top" side), the number of machine direction (MD) strands per inch (mesh) is from 10 to 200 and the number of cross-direction (CD) strands per inch (count) is also from 10 to 200; (2) the strand diameter is typically smaller than 0.050 inch; (3) on the top side, the distance between the highest point of the MD knuckles and the highest point on the CD knuckles is from about 0.001 to about 0.02 or 0.03 inch; (4) in between these two levels there can be knuckles formed either by MD or CD strands that give the topography a three dimensional hill/valley appearance which is imparted to the sheet; (5) the fabric may be oriented in any suitable way so as to achieve the desired effect on processing and on properties in the product; the long warp knuckles may be on the top side to increase MD ridges in the product, or the long shute knuckles may be on the top side if more CD ridges are desired to influence creping characteristics as the web is transferred from the transfer cylinder to the creping fabric; and (6) the fabric may be made to show certain geometric patterns that are pleasing to the eye, which is typically repeated between every two to 50 warp yarns. Suitable commercially available coarse fabrics include a number of fabrics made by Voith Fabrics.

The creping fabric may thus be of the class described in U.S. Pat. No. 5,607,551 to Farrington et al., Cols. 7-8 thereof, as well as the fabrics described in U.S. Pat. No. 4,239,065 to Trokhan and U.S. Pat. No. 3,974,025 to Ayers. Such fabrics may have about 20 to about 60 filaments per inch and are formed from monofilament polymeric fibers having diameters typically ranging from about 0.008 to about 0.025 inches. Both warp and weft monofilaments may, but need not necessarily be of the same diameter.

In some cases the filaments are so woven and complimentarily serpentinely configured in at least the Z-direction (the thickness of the fabric) to provide a first grouping or array of coplanar top-surface-plane crossovers of both sets of filaments; and a predetermined second grouping or array of sub-top-surface crossovers. The arrays are interspersed so that portions of the top-surface-plane crossovers define an array of wicker-basket-like cavities in the top surface of the fabric which cavities are disposed in staggered relation in both the machine direction (MD) and the cross-machine direction (CD), and so that each cavity spans at least one sub-top-surface crossover. The cavities are discretely perimetrically enclosed in the plan view by a picket-like-lineament comprising portions of a plurality of the top-surface plane crossovers. The loop of fabric may comprise heat set monofilaments of thermoplastic material; the top surfaces of the coplanar top-surface-plane crossovers may be monoplanar flat surfaces. Specific embodiments of the invention include satin weaves as well as hybrid weaves of three or greater sheds, and mesh counts of from about 10×10 to about 120×120 filaments per inch (4×4 to about 47×47 per centimeter), although the preferred range of mesh counts is from about 18 by 16 to about 55 by 48 filaments per inch (9×8 to about 22×19 per centimeter).

Instead of an impression fabric, a dryer fabric may be used as a textured creping fabric if so desired. Suitable fabrics are described in U.S. Pat. Nos. 5,449,026 (woven style) and 5,690,149 (stacked MD tape yarn style) to Lee as well as U.S. Pat. No. 4,490,925 to Smith (spiral style).

In order to provide additional bulk, a wet web is applied to a textured fabric and conformed to the textured fabric, by vacuum, for example. The web may have partially dried prior to conforming it to an impression fabric by way of wet pressing or thermal means.

If a Fourdrinier former or other gap former is used, the nascent web may be conditioned with vacuum boxes and a steam shroud until it reaches a solids content suitable for transferring to a dewatering felt. The nascent web may be transferred with vacuum assistance to the felt. In a crescent former, use of vacuum assist is unnecessary as the nascent web is formed between the forming fabric and the felt.

FIG. 1 is a schematic diagram of a papermachine 10 having a conventional twin wire forming section 12, a felt run 14, a shoe press section 16, a creping fabric 18 and a Yankee dryer 20 suitable for practicing the present invention. Forming section 12 includes a pair of forming fabrics 22, 24 supported by a plurality of rolls 26, 28, 30, 32, 34, 36 and a forming roll 38. A headbox 40 provides papermaking furnish issuing therefrom as a jet in the machine direction to a nip 42 between forming roll 38 and roll 26 and the fabrics. The furnish forms a nascent web 44 which is dewatered on the fabrics with the assistance of vacuum, for example, by way of vacuum box 46.

The nascent web is advanced to a papermaking felt 48 which is supported by a plurality of rolls 50, 52, 54, 55 and the felt is in contact with a shoe press roll 56. The web is of low consistency as it is transferred to the felt. Transfer may be assisted by vacuum; for example roll 50 may be a vacuum roll if so desired or a pickup or vacuum shoe as is known in the art. As the web reaches the shoe press roll it may have a consistency of 10-25 percent, preferably 20 to 25 percent or so as it enters nip 58 between shoe press roll 56 and transfer roll 60. Transfer roll 60 may be a heated roll if so desired. It has been found that increasing steam pressure to roll 60 helps lengthen the time between required stripping of excess adhesive from the cylinder of Yankee dryer 20. Suitable steam pressure may be about 95 psig or so, bearing in mind that roll 60 is a crowned roll and roll 70 has a negative crown to match such that the contact area between the rolls is influenced by the pressure in roll 60. Thus, care must be exercised to maintain matching contact between rolls 60, 70 when elevated pressure is employed.

Instead of a shoe press roll, roll 56 could be a conventional suction pressure roll. If a shoe press is employed, it is desirable and preferred that roll 54 is a vacuum roll effective to remove water from the felt prior to the felt entering the shoe press nip since water from the furnish will be pressed into the felt in the shoe press nip. In any case, using a vacuum roll at 54 is typically desirable to ensure the web remains in contact with the felt during the direction change as one of skill in the art will appreciate from the diagram.

Web 44 is wet-pressed on the felt in nip 58 with the assistance of pressure shoe 62. The web is thus compactively dewatered at 58, typically by increasing the consistency by 15 or more points at this stage of the process. The configuration shown at 58 is generally termed a shoe press; in connection with the present invention, cylinder 60 is operative as a transfer cylinder which operates to convey web 44 at high speed, typically 1000 fpm-6000 fpm, to the creping fabric.

Cylinder 60 has a smooth surface 64 which may be provided with adhesive (the same as the creping adhesive used on the Yankee cylinder) and/or release agents if needed. Web 44 is adhered to transfer surface 64 of cylinder 60 which is rotating at a high angular velocity as the web continues to advance in the machine-direction indicated by arrows 66. On the cylinder, web 44 has a generally random apparent distribution of fiber.

Direction 66 is referred to as the machine-direction (MD) of the web as well as that of papermachine 10; whereas the cross-machine-direction (CD) is the direction in the plane of the web perpendicular to the MD.

Web 44 enters nip 58 typically at consistencies of 10-25 percent or so and is dewatered and dried to consistencies of from about 25 to about 70 by the time it is transferred to creping fabric 18 as shown in the diagram.

Fabric 18 is supported on a plurality of rolls 68, 70, 72 and a press nip roll 74 and forms a fabric crepe nip 76 with transfer cylinder 60 as shown.

The creping fabric defines a creping nip over the distance in which creping fabric 18 is adapted to contact roll 60; that is, applies significant pressure to the web against the transfer cylinder. To this end, backing (or creping) roll 70 may be provided with a soft deformable surface which will increase the length of the creping nip and increase the fabric creping angle between the fabric and the sheet and the point of contact or a shoe press roll could be used as roll 70 to increase effective contact with the web in high impact fabric creping nip 76 where web 44 is transferred to fabric 18 and advanced in the machine-direction.

Creping nip 76 generally extends over a fabric creping nip distance of anywhere from about ⅛∴ to about 2", typically ½" to 2". For a creping fabric with 32 CD strands per inch, web 44 thus will encounter anywhere from about 4 to 64 weft filaments in the nip.

The nip pressure in nip 76, that is, the loading between backing roll 70 and transfer roll 60 is suitably 20-200, preferably 40-70 pounds per linear inch (PLI).

After fabric creping, the web continues to advance along MD 66 where it is wet-pressed onto Yankee cylinder 80 in transfer nip 82. Optionally, the web is vacuum molded by way of a vacuum box 45.

Transfer at nip 82 occurs at a web consistency of generally from about 25 to about 70 percent. At these consistencies, it is difficult to adhere the web to surface 84 of cylinder 80 firmly enough to remove the web from the fabric thoroughly. This aspect of the process is important, particularly when it is desired to use a high velocity drying hood.

The use of particular adhesives cooperate with a moderately moist web (25-70 percent consistency) to adhere it to the Yankee sufficiently to allow for high velocity operation of the system and high jet velocity impingement air drying and subsequent peeling of the web from the Yankee. In this connection, a poly(vinyl alcohol)/polyamide adhesive composition as noted above is applied at 86 as needed, preferably at a rate of less than about 40 mg/m$^2$ of sheet. Build-up is controlled as hereinafter described.

The web is dried on Yankee cylinder 80 which is a heated cylinder and by high jet velocity impingement air in Yankee hood 88. Hood 88 is capable of variable temperature. During operation, temperature may be monitored at wet end A of the Hood and dry end B of the hood using an infra-red detector or any other suitable means if so desired. As the cylinder rotates, web 44 is peeled from the cylinder at 89 and wound on a take-up reel 90. Reel 90 may be operated 5-30 fpm (preferably 10-20 fpm) faster than the Yankee cylinder at steady-state when the line speed is 2100 fpm, for example. A creping doctor C is normally used and a cleaning doctor D mounted for intermittent engagement is used to control build up. When adhesive build-up is being stripped from Yankee cylinder 80 the web is typically segregated from the product on reel 90, preferably being fed to a broke chute at 100 for recycle to the production process.

Instead of being peeled from cylinder 80 at 89 during steady-state operation as shown, the web may be creped from dryer cylinder 80 using a creping doctor such as creping doctor C, if so desired.

There is shown schematically in FIG. 2 another papermachine 10 which may be used in connection with the present invention. Papermachine 10 is a three fabric loop machine having a forming section 12 generally referred to in the art as a crescent former. Forming section 12 includes a forming wire 22 supported by a plurality of rolls such as rolls 32, 35. The forming section also includes a forming roll 38 which supports paper making felt 48 such that web 44 is formed directly on felt 48. Felt run 14 extends to a shoe press section 16 wherein the moist web is deposited on a transfer roll 60 as described above. Thereafter web 44 is creped onto fabric in fabric crepe nip between rolls 60, 70 before being deposited on Yankee dryer 20 in another press nip 82. Vacuum is optionally applied by vacuum box 45 as the web is held in fabric in order to conform the web to the textured fabric. Headbox 40 and press shoe 62 operate as noted above in connection with FIG. 1. The system includes a vacuum turning roll 54, in some embodiments; however, the three loop system may be configured in a variety of ways wherein a turning roll is not necessary.

Any suitable line arrangement may be used downstream of Yankee dryer 20 between the Yankee dryer and take up reel 90. One preferred layout is shown schematically in FIG. 3. There is shown a Yankee cylinder 80 upon which the sheet is dried and in proximity therewith a first foil 130 which has a rounded edge 132 adjacent the Yankee dryer. The rounded edge of the foil is in close proximity with the surface of cylinder 80. Preferably any open draw is provided with some form of stabilizing airfoil and there are provided tensioners so as to prevent wrinkling of the sheet.

As the sheet is peeled from cylinder 80 the sheet may contact rounded surface 132 of foil 130 inasmuch as the sheet is typically separated from the Yankee above the foil. Second and third airfoils 134, 138 stabilize the web over open draw along the production line. Thereafter a spreader bar or bow roll 136 may be used to apply tension to the web in order to prevent wrinkling as the web progresses to an optional calendar stack 142. Stack 142 may be used to calender the web especially if it is desired to reduce sidedness. While any suitable calender load may be employed, it is preferred that the calender load be between about 15 and about 25 pli.

Between calender stack 142 and reel 90 there is provided a Measurex® control instrument 150 to measure consistency and basis weight in order to provide data for feedback control of the papermachine. Fourth and fifth airfoils 144, 148 stabilize the web on either side of the Measurex® instrument. Another spreader bar or bow roll 146 is provided in front of reel 90 in order to tension the web. In utilizing the arrangement illustrated in FIG. 3, it is preferred that calender stack 142 be synchronized with reel 90 prior to loading the calender stack. After loading, reel 90 can be speeded up to be slightly faster than calendar stack 142 (3-10 fpm faster) to promote good winding.

Typical steady-state operating conditions, furnishes, add-on and towel basesheet properties achieved with papermachines of the class shown in FIGS. 1-3 for making towel appear in Table 2 below.

TABLE 2

Towel Composition and Properties

| | Roll ID | | | | | | | | | | | | |
|---|---|---|---|---|---|---|---|---|---|---|---|---|---|
| | A | B | C | D | E | F | G | H | I | J | K | L | M |
| MODE | Creped | Peeled | Peeled | Peeled | Peeled | Peeled | Peeled | Peeled | Peeled | Peeled | Peeled | Peeled | Peeled |
| Fabric Crepe % | 12% | 7% | 10% | 15% | 7% | 10% | 7% | 10% | 7% | 7% | 7% | 5% | 5% |
| PVOH/PAE (mg/m^2) | 54 | 25 | 25 | 25 | 21 | 21 | 18 | 18 | 20 | 20 | 20 | 20 | 20 |
| Modifier (ml/min) | 500 | 20 | 20 | 20 | 75 | 75 | 22 | 22 | 50 | 50 | 20 | 20 | 20 |
| Leaf River SWK % | | | | | | | | | | | | | |
| Camas B16 SWK % | | | | | 100% | 100% | | | 100% | 100% | 100% | 100% | 100% |
| Peace River SWK % | 60% | 80% | 80% | 80% | | | 100% | 100% | | | | | |
| Fox River 2nd Fiber % | 40% | 20% | 20% | 20% | | | | | | | | | |
| WSR (#/T) | 11 | 11 | 11 | 11 | 12 | 12 | 10 | 10 | 11 | 14 | 14 | 14 | 15 |
| Parez 631 (#/T) | 11 | 14 | 14 | 14 | 13 | 13 | 11 | 11 | 12 | 12 | 11 | 11 | 0 |
| CMC (#/T) | | | | | | | | | | | | | 5 |
| Refining (hp) | 80% | 80% | 80% | 80% | 80% | 80% | 80% | 80% | By Pass | By Pass | By Pass | By Pass | By Pass |
| Yankee Steam (psi) | 110 | 80 | 80 | 80 | 80 | 80 | 80 | 80 | 80 | 80 | 80 | 80 | 80 |
| Basis Weight (lbs/rm) | 23.4 | 23.6 | 23.5 | 22.6 | 22.9 | 22.6 | 23.1 | 22.6 | 23.3 | 23.0 | 22.9 | 22.9 | 23.2 |
| Caliper (mils/8 sheets) | 55.0 | 50.2 | 51.9 | 53.6 | 57.0 | 61.0 | 58.0 | 64.6 | 55.1 | 53.3 | 53.3 | 50.6 | 52.8 |
| Dry MD Tensile (g/3") | 5258 | 8177 | 6350 | 5331 | 6821 | 5831 | 6454 | 5382 | 5761 | 5482 | 5504 | 5205 | 6169 |
| Dry CD Tensile (g/3") | 3594 | 4282 | 4739 | 3558 | 4044 | 4294 | 3939 | 3235 | 3910 | 3758 | 3422 | 3134 | 3388 |
| MD Stretch (%) | 12 | 9 | 10 | 14 | 10 | 12 | 9 | 12 | 8 | 8 | 8 | 7 | 7 |
| CD Stretch (%) | 3 | 2 | 3 | 3 | 3 | 3 | 3 | 3 | 3 | 3 | 3 | 3 | 3 |
| Wet MD Cured Tensile (g/3") (Finch) | | 2125 | 1329 | 1570 | 1634 | 1484 | 1584 | 1506 | 1426 | 1255 | 1500 | 996 | 1691 |
| Wet CD Cured Tensile (g/3") (Finch) | 861 | 1061 | 835 | 881 | 889 | 1040 | 917 | 772 | 932 | 775 | 998 | 688 | 970 |
| WAR (seconds) (TAPPI) | 15 | 35 | 39 | 25 | 30 | 31 | 24 | 21 | 33 | 23 | 27 | 22 | 13 |
| Slow SAT (g/g) | 3.23 | 3.24 | 4.18 | 5.35 | 3.09 | 3.04 | 3.95 | 4.28 | 3.57 | 4.88 | 4.59 | 3.79 | 5.36 |
| GM Break Modulus | 712 | 1265 | 1048 | 700 | 934 | 798 | 934 | 697 | 1002 | 956 | 881 | 922 | 971 |
| Dry Tensile Ratio | 1.46 | 1.91 | 1.34 | 1.50 | 1.69 | 1.36 | 1.64 | 1.66 | 1.47 | 1.46 | 1.61 | 1.66 | 1.82 |
| CD Wet/Dry | 24% | 25% | 18% | 25% | 22% | 24% | 23% | 24% | 24% | 21% | 29% | 22% | 29% |

TABLE 2-continued

| Towel Composition and Properties | | | | | | | | | | | | | |
|---|---|---|---|---|---|---|---|---|---|---|---|---|---|
| | Roll ID | | | | | | | | | | | | |
| | A | B | C | D | E | F | G | H | I | J | K | L | M |
| Total Dust (mg/ft^2) | 3.62 | 1.85 | 0.72 | 0.83 | 0.34 | 0.18 | 1.03 | 1.26 | 0.38 | 0.30 | 0.80 | 1.02 | 0.75 |
| Bending Length (cm) | 2.63 | 4.16 | 4.00 | 3.43 | 4.12 | 4.00 | 3.71 | 3.44 | 3.93 | 3.86 | 3.74 | 3.80 | 4.09 |

Papermaking processes as described immediately above place difficult demands on adhesive compositions used in connection with the process in that the adhesive coating is relatively "hot" in the dryer as compared with a conventional CWP process because the web is typically shaped or textured before application to the Yankee cylinder, reducing surface area available for bonding and heat transfer between the sheet and cylinder.

When operating a papermachine of the class shown in FIGS. 1-3 under steady-state conditions for a period of several hours, adhesive tends to build-up on the Yankee drying cylinder, reducing heat transfer from the cylinder. The hood temperature is raised to maintain drying until the temperature in the hood becomes undesirably high and build up is controlled in accordance with the present invention. For example, when operating the papermachine of FIG. 1 in a process including peeling the web from cylinder 80, build-up of adhesive on the Yankee is controlled by way of the following sequence of steps:

(a) The reel is slowed down, reducing tension on the web, to drop the sheet to creping doctor C, and the web is fed to a broke chute instead of accumulated on reel 90 when the system is operated in this creping mode.

(b) The hood temperature is reduced, for example, from a wet end (A) temperature of 880° F./dry end (B) temperature of 880° F. to a wet end temperature of 830° F./dry end temperature of 700° F. to prevent excess heat from hardening the coating.

(c) The add-on of PVOH is increased above the steady-state add-on rate, for example from about 15 mg/m$^2$ to about 32 mg/m$^2$, one to three minutes before cleaning doctor D is engaged to the drying cylinder and starts to strip the old coating. Increased PVOH levels help enhance or at least maintain wet-tack properties of the system even during transient variations in heat-transfer to the adhesive coating which can cause hardening and loss of wet-tack when the existing coating is stripped. Moreover, increased PVOH levels help to quickly establish the new coating layer and enhance the wet-tack for better adhesion between the sheet and the Yankee dryer immediately after the pressure roll nip where the web is applied to the Yankee drying cylinder. Steps (a)-(c) may each have a duration of 3-4 minutes and may be concurrent.

(d) The duration of the coating stripping with a new cleaning doctor is preferably accomplished as briefly as possible, in a few seconds, to ensure that the thick old coating layer is removed from the Yankee but that the Yankee is not too shiny, in other words after the old coating is stripped off, cleaning doctor D should remain in a disengaged position until the next cleaning cycle and it is preferred not to remove the coating completely. A very thin layer of durable coating is preferably left on the Yankee cylinder surface.

(e) The sheet is evaluated with the creping doctor in contact with the Yankee to ensure no blistering spots are present before speeding up the reel to resume the steady-state peeling process.

(f) Once the peeling process is restarted, the PVOH add-on should be resumed to normal steady-state setting, e.g., about 15 mg/m$^2$ in a relatively short period of time, for example, over a one to three minute period to avoid excessive coating build-up.

The Yankee cleaning process and associated steps (a-f) above are advantageously carried out over an elapsed time of 5-20 minutes. Preferably, the entire process and associated steps are completed in 7-15 minutes, so that even less material needs to be recycled from the segregated material.

The above procedure for controlling build-up may be adapted to any conventional paper making process or processes hereafter developed utilizing a creping adhesive and drying cylinder as will be appreciated by one of skill in the art. The invention is especially useful in connection with papermaking processes wherein the adhesive coating temperature on a drying cylinder is higher than in conventional processes such as conventional CWP processes.

While the invention has been described in detail, modifications within the spirit and scope of the invention will be readily apparent to those of skill in the art. In view of the foregoing discussion, relevant knowledge in the art and references including co-pending applications discussed above in connection with the Background and Detailed Description, the disclosures of which are all incorporated herein by reference, further description is deemed unnecessary.

What is claimed is:

1. In a continuous process of manufacturing absorbent sheet of the class used for tissue and towel including forming a wet cellulosic web, applying the web onto a drying cylinder of a dryer, which drying cylinder is provided with a resinous adhesive at a substantially constant add-on rate during steady-state operation and accumulating absorbent sheet on a reel, the improvement comprising controlling build-up of an adhesive coating on the drying cylinder by way of intermittently:

(a) increasing the add-on rate of resinous adhesive to the drying cylinder above the steady-state add-on rate;

(b) segregating absorbent sheet product produced while the add-on rate of resinous adhesive to the drying cylinder is elevated above the steady-state add-on rate from absorbent sheet product accumulated on the reel during steady-state operation; and (c) while the add-on rate of resinous adhesive to the drying cylinder is increased above the steady-state add-on rate, stripping at least a portion of the adhesive coating from the drying cylinder with a cleaning doctor.

2. The improvement according to claim 1, wherein the resinous adhesive comprises a polyvinyl alcohol ("PVOH") resin and a polyamide-epihalohydrin resin in substantially fixed proportion during steady-state operation and the increase of resinous adhesive add-on rate to the drying cylinder above the steady-state add-on rate is achieved by increasing the add-on rate of PVOH resin above a steady-state add-on rate of PVOH resin while maintaining the add-on rate of polyamide-epihalohydrin resin substantially at its rate of addition during steady-state operation.

3. The improvement according to claim 1, wherein a major portion of the coating is stripped from the drying cylinder.

4. The improvement according to claim 3, wherein at least about 85% of the coating thickness is stripped from the drying cylinder.

5. The improvement according to claim 1, wherein the resinous adhesive is re-wettable and comprises polyvinyl alcohol.

6. The improvement according to claim 5, wherein the resinous adhesive composition consists essentially of a polyvinyl alcohol resin and a polyamide-epichlorohydrin resin.

7. The improvement according to claim 5, wherein the weight ratio of polyvinyl alcohol resin to polyamide-epichlorohydrin resin is from about 2 to about 4.

8. The improvement according to claim 5, wherein the add-on rate of polyvinyl alcohol rate is increased by at least about 50% with respect to a steady-state add-on rate of polyvinyl alcohol.

9. The improvement according to claim 5, wherein the add-on rate of polyvinyl alcohol rate is increased by at least about 100% with respect to a steady-state add-on rate of polyvinyl alcohol.

10. The improvement according to claim 1, wherein absorbent sheet is peeled from the drying cylinder during steady state operation.

11. The improvement according to claim 1, wherein the dryer is provided with a dryer hood capable of variable temperature and the temperature of the dryer hood is lowered during the step of stripping resinous adhesive from the drying cylinder.

12. The improvement according to claim 11, wherein the hood temperature at a dry-end is lowered by at least about 25° F. during the step of stripping resinous adhesive from the drying cylinder, and the hood temperature at a wet end is lowered by at least about 25° F.

13. The improvement according to claim 11, wherein the hood temperature at a dry-end is lowered by at least about 50° F. during the step of stripping resinous adhesive from the drying cylinder, and the hood temperature at a wet end is lowered by at least about 50° F.

14. The improvement according to claim 11, wherein the hood temperature at a dry-end is lowered by at least about 100° F. during the step of stripping resinous adhesive from the drying cylinder, and the hood temperature at a wet end is lowered by at least about 100° F.

15. The improvement according to claim 1, wherein the resinous adhesive coating composition is employed at an add-on rate of less than about 40 mg/m$^2$ during steady-state operation.

16. The improvement according to claim 1, wherein the resinous adhesive coating composition is employed at an add-on rate of less than about 35 mg/m$^2$ during steady-state operation.

17. The improvement according to claim 1, wherein the resinous adhesive coating composition is employed at an add-on rate of less than about 25 mg/m$^2$ during steady-state operation.

18. The improvement according to claim 1, wherein the resinous adhesive add-on rate is from about 15 mg/m$^2$ to about 60 mg/m$^2$ during steady-state operation.

19. The improvement according to claim 18, wherein the web is peeled from the drying cylinder during steady-state operation of the process.

20. The improvement according to claim 1, wherein the web is creped from the drying cylinder with a creping doctor during steady-state operation of the process.

21. The improvement according to claim 1, wherein the absorbent sheet has a basis weight of from about 10 lbs/3000 ft$^2$ to about 30 lbs /3000 ft$^2$.

22. The improvement according to claim 1, wherein the absorbent sheet has a basis weight of from about 15 lbs/3000 ft$^2$ to about 21 lbs /3000 ft$^2$.

23. The improvement according to claim 1, wherein the resinous adhesive comprises a creping modifier.

24. The improvement according to claim 23, wherein the creping modifier includes a quaternary ammonium complex.

25. The improvement according to claim 23, wherein the creping modifier includes a quaternary ammonium complex and non-cyclic amide functionality.

26. The improvement according to claim 1, wherein at least a portion of the segregated absorbent sheet product is recycled to the process.

27. The improvement according to claim 1, wherein the segregated absorbent sheet product is sent to a broke chute.

28. In a continuous process of manufacturing absorbent sheet of the class used for tissue and towel including forming a wet cellulosic web, applying the web onto a drying cylinder of a dryer, which drying cylinder is provided with a resinous adhesive comprising a polyvinyl alcohol adhesive resin at a substantially constant add-on rate during steady-state operation, the improvement comprising controlling build-up of an adhesive coating on the drying cylinder by way of intermittently:

(a) increasing the add-on rate of polyvinyl alcohol adhesive resin to the drying cylinder above the steady-state add-on rate; and (b) while the add-on rate of polyvinyl alcohol adhesive resin to the drying cylinder is increased above the steady-state add-on rate, stripping at least a portion of the adhesive coating from the drying cylinder with a cleaning doctor.

29. In a continuous process of manufacturing absorbent sheet of the class used for tissue and towel including forming a wet cellulosic web, applying the web onto a drying cylinder of a dryer, which drying cylinder is provided with a resinous adhesive at a substantially constant add-on rate during steady-state operation, wherein the resin adhesive consists essentially of a PVOH resin and an epihalohydrin resin in substantially fixed proportion in steady-state operation and the dryer is further provided with a dryer hood capable of variable temperature, the improvement comprising controlling build-up of an adhesive coating on the drying cylinder by way of stripping at least a portion of the adhesive coating from the drying cylinder with a cleaning doctor while controlling wet-tack to the drying cylinder by way of a technique selected from the group consisting of:

(a) lowering the hood temperature before stripping the coating;

(b) changing the resinous adhesive composition before stripping the coating; and (c) increasing the add-on rate of resinous adhesive above the steady-state add-on rate before stripping the coating.

30. The improvement according to claim 29, wherein wet-tack to the drying cylinder is controlled by combinations of two or more of techniques (a), (b) and (c).

31. The improvement according to claim 29, wherein the resinous adhesive composition is from about 60% by weight to about 70% by weight PVOH resin during steady rate operation.

32. The improvement according to claim 29, wherein the resinous adhesive composition is from about 75% by weight to about 90% by weight PVOH resin during steady rate operation.

33. In a continuous process of manufacturing absorbent sheet of the class used for tissue and towel including forming a wet cellulosic web, applying the web onto a drying cylinder of a Yankee dryer, which drying cylinder is provided with a resinous adhesive at a substantially constant add-on rate during steady-state operation and which Yankee dryer is provided with a dryer hood capable of variable temperature, the improvement comprising controlling build-up of an adhesive coating on the drying cylinder by way of intermittently:

(a) stripping at least a portion of the adhesive coating from the drying cylinder with a cleaning doctor, and (b) while stripping at least a portion of the adhesive coating from the drying cylinder, controlling the temperature of the dryer such that the adhesive coating temperature does not exceed about 300° F. contemporaneously with the step of stripping adhesive from the drying cylinder.

34. The improvement according to claim 33, including controlling the temperature of the dryer such that the temperature of the adhesive coating does not exceed about 280° F. contemporaneously with the step of stripping adhesive from the drying cylinder.

35. The improvement according to claim 33, wherein the dryer temperature is controlled by varying the hood temperature.

36. The improvement according to claim 33, wherein the dryer temperature is controlled by varying the drying cylinder steam pressure.

37. in a continuous process of manufacturing absorbent sheet of the class used for tissue and towel including forming a wet cellulosic web, applying the web onto a drying cylinder of a Yankee dryer which drying cylinder is provided with a resinous adhesive at a substantially constant add-on rate during steady-state operation and which Yankee dryer is provided with a dryer hood capable of variable temperature, the improvement comprising controlling build-up of an adhesive coating on the drying cylinder by way of intermittently:

(a) stripping at least a portion of the adhesive coating from the drying cylinder with a cleaning doctor;

(b) while stripping at least a portion of the adhesive coating from the drying cylinder controlling the temperature of the dryer such that the adhesive coating temperature does not exceed about 300° F. contemporaneously with the step of stripping adhesive from the drying cylinder; and (c) segregating product produced contemporaneously with stripping a portion of the coating from the drying cylinder from product produced during steady-state operation.

38. A continuous process for producing absorbent sheet comprising:

(a) forming a wet cellulosic web;

(b) at least partially dewatering the wet web;

(c) adhering the web to a drying cylinder with a resinous adhesive coating composition applied at a substantially constant add-on rate during steady-state operation;

(d) drying the web on the drying cylinder;

(e) peeling the web from the drying cylinder under steady-state tension; and (f) winding the peeled web under steady-state tension to take up reel operating at a steady-state speed, wherein build-up of adhesive on the drying cylinder is controlled by way of intermittently:

(g) increasing the add-on rate of resinous adhesive to the drying cylinder above the steady-state add-on rate; and (h) while the add-on rate of resinous adhesive to the drying cylinder is increased above the steady-state add-on rate, stripping at least a portion of the adhesive coating from the drying cylinder with a cleaning doctor.

39. The process according to claim 38, including the step of reducing tension on the web concurrently with steps (g) and (h) by way of reducing the steady-state speed of the reel.

40. The process according to claim 39, wherein the drying cylinder is provided with a creping doctor which is positioned so that it contacts and crepes the web at reduced tension and does not contact the web during steady-state operation.

41. The process according to claim 39, further including the step of evaluating adhesion of the web to the drying cylinder concurrently with step (g) prior to resuming steady-state operation.

42. The process according to claim 38, wherein the web is at least partially dewatered by way of wet pressing prior to adhering the web to the drying cylinder.

43. The process according to claim 38, wherein the web is at least partially dewatered by way of thermal dewatering prior to adhering the web to the drying cylinder.

44. The process according to claim 43, wherein the web is at least partially dewatered by throughdrying prior to adhering the web to the drying cylinder.

45. The process according to claim 43, wherein the web is at least partially dewatered by impingement-air drying prior to adhering the web to the drying cylinder.

46. A continuous process for producing absorbent sheet comprising:

(a) forming a wet cellulosic web;

(b) at least partially dewatering the wet web;

(c) adhering the web to a drying cylinder with a resinous adhesive coating composition applied at a substantially constant add-on rate during steady-state operation;

(d) drying the web on the drying cylinder;

(e) peeling the web from the drying cylinder under steady-state tension: and (f) winding the peeled web under steady-state tension to take up reel operating at a steady-state speed, wherein build-up of adhesive on the drying cylinder is controlled by way of intermittently;

(g) increasing the add-on rate of resinous adhesive to the drying cylinder above the steady-state add-on rate;

(h) while the add-on rate of resinous adhesive to the drying cylinder is increased above the steady-state add-on rate, stripping at least a portion of the adhesive coating from the drying cylinder with cleaning doctor: and (i) segregating product produced contemporaneously with stripping a portion of the coating from the drying cylinder from product produced during steady-state operation.

47. A continuous process for producing absorbent sheet comprising:

(a) forming a wet cellulosic web;

(b) at least partially dewatering the wet web;

(c) transferring the partially dewatered web to a textured fabric;

(d) texturing the wet web by conforming it to the textured fabric;

(e) transferring the wet web to a drying cylinder;

(f) adhering the web to a drying cylinder with a resinous adhesive coating composition applied at a substantially constant add-on rate during steady-state operation; and (g) drying the wet web on the drying cylinder;

wherein the build-up of adhesive on the drying cylinder is controlled by way of intermittently:

(h) increasing the add-on rate of resinous adhesive to the drying cylinder above the steady-state add-on rate; and (i) while the add-on rate of resinous adhesive to the drying cylinder is increased above the steady-state add-on rate, stripping at least a portion of the adhesive coating from the drying cylinder with a cleaning doctor.

48. A continuous process for producing absorbent sheet comprising:

(a) forming a wet cellulosic web:

(b) at least partially dewatering the wet web;

(c) transferring the partially dewatered web to a textured fabric;

(d) texturing the wet web by conforming it to the textured fabric;

(e) transferring the wet web to a drying cylinder;

(f) adhering the web to a drying cylinder with a resinous adhesive coating composition applied at a substantially constant add-on rate during steady-state operation: and (g) drying the wet web on the drying cylinder;

wherein the build-up of adhesive on the drying cylinder is controlled by way of intermittently;

(h) increasing the add-on rate of resinous adhesive to the drying cylinder above the steady-state add-on rate;

(i) while the add-on rate of resinous adhesive to the drying cylinder is increased above the steady-state add-on rate, stripping at least a portion of the adhesive coating from the drying cylinder with a cleaning doctor: and (j) segregating product produced contemporaneously with stripping a portion of the coating from the drying cylinder from product produced during steady-state operation.

49. In a continuous process of manufacturing absorbent sheet of the class used for tissue and towel including forming a wet cellulosic web, applying the web onto a drying cylinder of a dryer, which drying cylinder is provided with a resinous adhesive at a substantially constant add-on rate during steady-state operation and accumulating the absorbent sheet on a reel, the improvement comprising controlling build-up of an adhesive coating on the drying cylinder by way of intermittently:

(a) increasing the add-on rate of resinous adhesive to the drying cylinder above the steady-state add-on rate;

(b) segregating the absorbent sheet product produced while the add-on rate of resinous adhesive to the drying cylinder is elevated above the steady-state add-on rate from the absorbent sheet product accumulated on the reel during steady-state operation; and (c) while the add-on rate of resinous adhesive to the drying cylinder is increased above the steady-state add-on rate, stripping at least a portion of the adhesive coating from the drying cylinder with a cleaning doctor; and (d) while the add-on rate of resinous adhesive to the drying cylinder is increased above the steady-state add-on rate, creping the web from the drying cylinder.

50. In a continuous process of manufacturing absorbent sheet of the class used for tissue and towel including fanning a wet cellulosic web, applying the web onto a drying cylinder of a dryer which drying cylinder is provided with a resinous adhesive at a substantially constant add-on rate during steady-state operation and accumulating the absorbent sheet on a reel, the improvement comprising controlling build-up of an adhesive coating on the drying cylinder by way of intermittently:

(a) increasing the add-on rate of resinous adhesive to the drying cylinder above the steady-state add-on rate;

(b) segregating the absorbent sheet product produced while the add-on rate of resinous adhesive to the drying cylinder is elevated above the steady-state add-on rate from the absorbent sheet product accumulated on the reel during steady-state operation: and (c) while the add-on rate of resinous adhesive to the drying cylinder is increased above the steady-state add-on rate, stripping at least a portion of the adhesive coating from the drying cylinder with a cleaning doctor;

(d) while the add-on rate of resinous adhesive to the drying cylinder is increased above the steady-state add-on rate creping the web from the drying cylinder, and (e) segregating product produced contemporaneously with stripping a portion of the coating from the drying cylinder from product produced during steady-state operation.

51. In a continuous process of manufacturing absorbent sheet of the class used for tissue and towel including forming a wet cellulosic web, applying the web onto a drying cylinder of a dryer which drying cylinder is provided with a resinous adhesive at a substantially constant add-on rate during steady-state operation and accumulating the absorbent sheet on a reel, the improvement comprising controlling build-up of an adhesive coating on the drying cylinder by way of intermittently:

(a) increasing the add-on rate of resinous adhesive to the drying cylinder above the steady-state add-on rate;

(b) segregating the absorbent sheet product produced while the add-on rate of resinous adhesive to the drying cylinder is elevated above the steady-state add-on rate from the absorbent sheet product accumulated on the reel during steady-state operation; and (c) while the add-on rate of resinous adhesive to the drying cylinder is increased above the steady-state add-on rate stripping at least a portion of the adhesive coating from the drying cylinder with a cleaning doctor;

(d) while the add-on rate of resinous adhesive to the drying cylinder is increased above the steady-state add-on rate creping the web from the drying cylinder; and (e) wherein the dryer is provided with a dryer hood capable of variable temperature and the temperature of the dryer hood is lowered during the step of stripping resinous adhesive from the drying cylinder.

* * * * *